United States Patent [19]

Ueda et al.

[11] Patent Number: 4,956,267

[45] Date of Patent: Sep. 11, 1990

[54] METHOD FOR FORMING A DIRECT POSITIVE COLOR IMAGE

[75] Inventors: Shinji Ueda; Tatsuo Heki; Noriyuki Inoue; Takatoshi Ishikawa; Nobutaka Ohki; Morio Yagihara; Kiyoshi Morimoto; Hiroshi Fujimoto; Kazuto Andoh, all of Minami-Ashigara, Japan

[73] Assignee: Fuji Photo Film Co., Ltd., Kanagawa, Japan

[21] Appl. No.: 200,268

[22] Filed: May 31, 1988

Related U.S. Application Data

[63] Continuation-in-part of Ser. No. 172,818, Mar. 25, 1988, abandoned.

[30] Foreign Application Priority Data

Mar. 25, 1987 [JP] Japan ..... 62-71041
Mar. 26, 1987 [JP] Japan ..... 62-72573
Mar. 26, 1987 [JP] Japan ..... 62-72574

[51] Int. Cl.[5] ..... G03C 7/46

[52] U.S. Cl. ..... 430/372; 430/378; 430/380; 430/440; 430/468; 430/490; 430/491

[58] Field of Search ..... 430/372, 378, 380, 468, 430/490, 491, 440, 372, 378, 380, 468, 490, 491

[56] References Cited

U.S. PATENT DOCUMENTS

| | | | |
|---|---|---|---|
| 2,588,982 | 3/1952 | Ives | 95/88 |
| 3,141,771 | 7/1964 | Bard et al. | 430/468 |
| 3,201,246 | 8/1965 | Allen et al. | 430/419 |
| 4,128,425 | 12/1978 | Greenwald | 430/440 |
| 4,264,716 | 4/1981 | Vincent et al. | 430/380 |
| 4,269,929 | 5/1981 | Nothnagle | 430/264 |
| 4,330,616 | 5/1982 | Kurematsu et al. | 430/376 |
| 4,395,478 | 7/1983 | Hoyen | 430/217 |
| 4,582,779 | 4/1986 | Kubota et al. | 430/409 |
| 4,614,707 | 9/1986 | Fujita et al. | 430/379 |
| 4,789,627 | 12/1988 | Inoue et al. | 430/406 |
| 4,835,091 | 5/1989 | Inoue et al. | 430/378 |

FOREIGN PATENT DOCUMENTS

| | | | |
|---|---|---|---|
| 326030 | 7/1973 | European Pat. Off. . | |
| 53-32035 | 4/1978 | Japan . | |
| 1269640 | 7/1968 | United Kingdom | 430/380 |

OTHER PUBLICATIONS

Patent Abstracts of Japan, vol. 2, No. 65 (E-34), May 18, 1978, p. 2265 E 78; & JP-A-53 32 035 (Fuji Shashin Film K.K.) 25-03-1978.

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A method for forming a direct positive color image by image-wise exposing to light a light-sensitive material having at least one internal latent image type silver halide emulsion layer which is unfogged and color image-forming couplers on a support; either (1) subjecting the resulting material to fogging exposure to light and/or processing it with a nucleating agent before development, and then developing the resulting material with a surface developing solution containing an aromatic primary amine type color developing agent, or (2) developing the material after the image-wise exposure with a surface developing solution containing an aromatic primary amine type color developing agent under fogging exposure and/or in the presence of a nucleating agent; and bleach-fixing the resulting material, wherein the color developing solution contains at least one compound selected from the group consisting of compounds represented by the following general formulae (I), (II), (III) and (IV):

$$R^1-X-NHNH-R^2 \quad (I)$$

wherein X represents —CO—, —$SO_2$— or $$-\overset{\overset{NH}{\|}}{C}-,$$

and $R^1$ and $R^2$ represents various familiar group;

(II)

wherein $R^3$, $R^4$, $R^5$ and $R^6$ represent various familiar groups;

(III)

wherein $R^7$ and $R^8$ represent various familiar groups;

(IV)

wherein Y represents a trivalent atomic group necessary for completing a condensed ring, m represents an integer of 0 to 4, and n represents an integer of 1 to 5.

Stability of the color developing solutions with time lapse is excellent, which makes stable continuous process of color photographic light-sensitive materials possible over a long period.

10 Claims, No Drawings

METHOD FOR FORMING A DIRECT POSITIVE COLOR IMAGE

CROSS-REFERENCE TO RELATED APPLICATIONS

This is a continuation-in-part of Ser. No. 172,818, filed Mar. 25, 1988, now abandoned.

BACKGROUND OF THE INVENTION

1. Field of the Invention

The present invention relates to a method for processing silver halide color photographic light-sensitive materials, and particularly relates to a method for forming a direct positive color image whereby stability and coloring property of color developing solutions are enhanced and increase of fog during continuous process is remarkably reduced.

2. Description of the Prior Art

Color developing solutions containing an aromatic primary amine color developing agent have been used from long ago for formation of color images, and nowadays play a central role in methods for formation of color photographic images. However, the color developing solutions have a problem that they are very susceptible to oxidation by air or metals. It is well known that when color images are formed using an oxidized developing solution, desired photographic performances cannot be obtained owing to increase of fog, change of sensitivity and gradation or the like.

Therefore, methods for enhancing preservative property of various color developing solutions have hitherto been tried, and a method wherein hydroxylamine and sulfite ion are used together is most general among them. However, by decomposition hydroxylamine generates ammonia which causes fog, and sulfite ions has a drawback that they act as a competitive compound of developing agents to inhibit coloring property. Thus either of them are not always proper as compounds for enhancing preservative property of color developing solutions (i.e., preservatives).

Particularly as for sulfite ions, though they have been used from long ago as a compound for inhibiting decomposition of hydroxylamine, they have a great coloring property - inhibiting action, and strikingly lower color density when they are used in a system where benzyl alcohol is not contained which is harmful from the viewpoint of environmental pollution and in preparation of liquids such as color developing solutions.

Alkarolamines (Japanese Patent Unexamined Published Application (hereinafter referred to as "J.P. KOKAI") No. 54-3532) and polyethyleneimines (J.P. KOKAI No. 56-94349) have been proposed as a compound usable in place of sulfite, but they could not attain an adequate effect.

Various preservatives other than hydroxylamine and sulfite and chelating agents have hitherto been tried for enhancing stability of color developing solutions. Examples of such preservatives include aromatic polyhydroxy compounds disclosed in J.P. KOKAI Nos. 52-49828, 59-160142 and 56-47038, U.S. Pat. No. 3,746,544 and the like, hydroxycarbonyl compounds disclosed in U.S. Pat. No. 3,615,503 and UK Pat. No. 1,306,176, α-aminocarbonyl compounds disclosed in J.P. KOKAI Nos. 52-143020 and 53-89425, metal salts disclosed in J.P. KOKAI Nos. 57-44148 and 57-53749, hydroxamic acid disclosed in J.P. KOKAI No. 52-27638, and the like. Examples of such chelating agents include aminopolycarboxylic acids disclosed in Japanese Patent Publication for Opposition Purpose (hereinafter referred to as "J.P. KOKOKU") Nos. 48-30496 and 44-30232, organic phosphonic acids disclosed in J.P. KOKAI No. 56-97347, J.P. KOKOKU No. 56-39359 and West Germany Pat. No. 2,227,639, phosphonocarboxylic acids disclosed in J.P. KOKAI Nos. 52-102726, 53-42730, 54-121127, 55-126241 and 55-65956 and the like, and further compounds disclosed in J.P. KOKAI Nos. 58-195845 and 58-203440, J.P. KOKOKU No. 53-40900 and the like.

However, satisfactory results have not been obtained even by use of these techniques since these compounds have only an inadequate preservative property or have a bad influence on photographic performances. Thus, excellent preservatives usable particularly in place of sulfite have been desired.

Further, it is disclosed in J.P. KOKAI Nos. 58-95345 and 59-232342 that fogs are liable to be formed during color development in color image light-sensitive materials containing an silver chlorobromide emulsion of much chlorine content. When such emulsions are used, preservatives having a low solubility in them and having more excellent preservative performances are necessary, and also in such a sense no satisfactory preservative has been found out.

SUMMARY OF THE INVENTION

Therefore, an object of the invention is to provide a method for forming direct positive color images whereby stability of color developing solutions is enhanced and formation of reversal negative images during continuous process is remarkably reduced.

Another object of the invention is to provide a method for forming direct positive color images with an excellent coloring property even when a color developing solution containing substantially no benzyl alcohol is used.

The above objects of the invention has now been attained a method for forming a direct positive color image by image-wise exposing to light a light-sensitive material having at least one internal latent image type silver halide emulsion layer which is unfogged and color image-forming couplers on a support; either (1) subjecting the resulting material to fogging exposure to light and/or processing it with a nucleating agent before development, and then developing the resulting material with a surface developing solution containing an aromatic primary amine type color developing agent, or (2) developing the material after the image-wise exposure with a surface developing solution containing an aromatic primary amine type color developing agent under fogging exposure and/or in the presence of a nucleating agent; and bleach-fixing the resulting material, wherein the color developing solution contains at least one compound selected from the group consisting of compounds represented by the following general formula (I), (II), (III) or (IV) and a dimer and a polymer which are obtained by dimerizing or polymerizing the compound of the formula (I), (II) or (IV);

General formula (I)

$$R^1-X-NHNH-R^2$$

wherein X represents a divalent group selected from —CO—, —$SO_2$— and $$-\overset{\overset{\displaystyle NH}{\|}}{C}-,$$

$R^1$ represents a hydroxyl group, a hydroxyamino group or a substituted or unsubstituted carbamoyl group, a substituted or unsubstituted hydrazinocarbonyl group, an substituted or unsubstituted amino group or a substituted or unsubstituted hydrazino group, $R^2$ represents a hydrogen atom, a substituted or unsubstituted alkyl group, or a substituted or unsubstituted aryl group;

General formula (II)

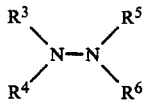

wherein $R^3$, $R^4$, $R^5$ and $R^6$ independently represent a hydrogen atom, a substituted or unsubstituted alkyl group, a substituted or unsubstituted aryl group, or a substituted or unsubstituted heterocyclic group, $R^3$ and $R^4$, and $R^5$ and $R^6$ may each combine to form a heterocycle;

General formula (III)

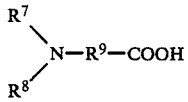

wherein $R^7$ and $R^8$ each represent a hydrogen atom, or a substituted or unsubstituted alkyl group, $R^9$ represents a substituted or unsubstituted alkylene group, and sum of carbon umber of $R^7$, $R^8$ and $R^9$ are 3 or more;

General formula (IV)

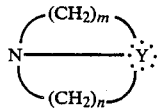

wherein Y represents a trivalent atomic group necessary for completing a condensed ring, m represents an integer of 0 to 4, and n represents an integer of 1 to 5.

Hydrazides represented by the general formula (I) are described in more detail below.

General formula (I)

$R^1$—X—NHNH—$R^2$ wherein X represents a divalent group selected from —CO—, —$SO_2$— and $$-\overset{\overset{\displaystyle NH}{\|}}{C}-,$$

and $R^1$ represents a hydroxyl group, a hydroxyamino group, a substituted or unsubstituted carbamoyl group, a substituted or unsubstituted hydrazinocarbonyl group, a substituted or unsubstituted amino group (preferably having 0 to 10 carbon atoms, for example, an amino, diethylamino or dipropylamino group or the like), or a substituted or unsubstituted hydrazino group (preferably having 0 to 10 carbon atoms, for example, an N',N'-dimethylhydrazino or N'-phenylhydrazino group or the like).

$R^1$ also represents a hydrogen atom, a substituted or unsubstituted alkyl group (preferably having 1 to 10 carbon atoms, for example, a methyl, ethyl, cyclohexyl, methoxyethyl or benzyl group or the like), a substituted or unsubstituted aryl group (preferably having 6 to 10 carbon atoms, for example, a phenyl, p-tolyl, 2-hydroxyphenyl or 2-aminophenyl group or the like), a substituted or unsubstituted heterocyclic group (preferably having 1 to 10 carbon atoms, more preferably being 5- or 6-membered ring and containing at least one of oxygen, nitrogen, sulfur and so on as heterocyclic atom(s), for example, a 4-pyridyl or N-acetylpiperidin-4-yl group or the like), a substituted or unsubstituted alkoxy group (preferably having 1 to 10 carbon atoms, for example, a methoxy, ethoxy, butoxy, methoxyethoxy or benzyloxy group or the like), or a substituted or unsubstituted aryloxy group (perferably having 6 to 10 carbon atoms, for example, a phenoxy or p-methoxyphenoxy group or the like).

$R^2$ represents a hydrogen atom, a substituted or unsubstituted alkyl group (preferably having 6 to 10 carbon atoms, for example, a methyl, ethyl, cyclohexyl or methoxyethyl group or the like), or a substituted or unsubstituted aryl group (preferably having 6 to 10 carbon atoms, for example, a phenyl or 3-hydroxyphenyl group or the like).

Preferred examples of group(s) with which $R^1$ and/or $R^2$ may be substituted include halogen atom(s) (for example, chlorine atom(s), bromine atom(s) or the like), hydroxyl group(s), carboxyl group(s), sulfo group(s), amino group(s), alkoxy group(s), amido group(s), alkane- or arylsulfonamido group(s), carbamoyl group(s), sulfamoyl group(s), alkyl group(s), aryl group(s) and so on, and they may further be substituted.

Preferred examples of $R^1$ in the general formula (I) include an amino group, a hydrazino group, a hydrogen atom, an alkyl group, an aryl group and an alkoxy group.

Preferred examples of $R^2$ in the general formula (I) include a hydrogen atom and an alkyl group, particularly a hydrogen atom.

When a compound represented by the general formula (I) is a monomer, the sum of its carbon number is preferably 15 or less, more preferably 10 or less and most preferably 7 or less.

A compound of the general formula (I) may be in the form of a bis compound, a tris compound or a polymer where two or more compounds of the formula (I) are linked through $R^1$ or $R^2$.

Specific examples of compounds represented by the general formula (I) are illustrated below, but the invention should not be interpreted to be limited thereto.

$NH_2NHCONH_2$ (I-1)

$$NH_2N\overset{\overset{\displaystyle NH}{\|}}{C}NH_2 \quad \text{(I-2)}$$

$NH_2NHCONHNH_2$ (I-3)

$NH_2NHSO_3H$ (I-4)

$NH_2NHSO_2NHNH_2$ (I-5)

$NH_2NHCONHOH$ (I-6)

-continued
(I-7)
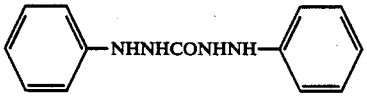
(I-8)
$CH_3NHNHC(=NH)NH_2$
(I-9) $CH_3NHNHSO_2NHNHCH_3$
(I-10) $NH_2NHCONH-(CH_2)_3-NHCONHNH_2$
(I-11)
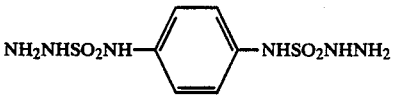
(I-12) $NH_2NHCONHCH_3$
(I-13)
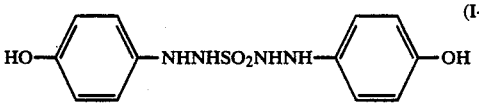
(I-14) $NH_2NH_2SO_2NHOH$
(I-15)
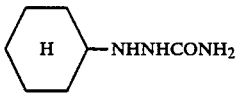
(I-16) $NH_2NHCONHCONHNH_2$
(I-17)
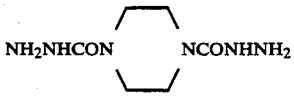
(I-18)
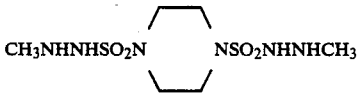
(I-19)
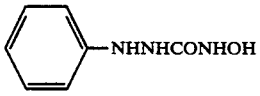
(I-20)
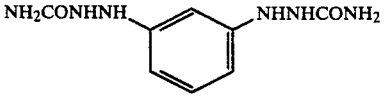
(I-21) $NH_2COCONHNH_2$
(I-22) $NH_2NHCOCONHNH_2$
(I-23)
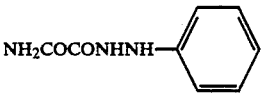
(I-24) $NH_2NHCOOC_2H_5$
(I-25) $NH_2NHCOCH_3$
(I-26)
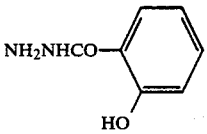
(I-27)
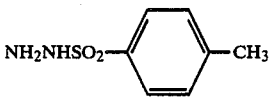
(I-28) $NH_2NHSO_2CH_3$
(I-29)
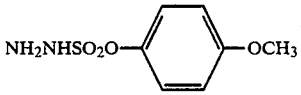
(I-30) $CH_3NHNHCOOC_2H_4OCH_3$
(I-31)
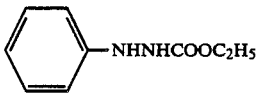
(I-32)
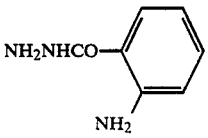
(I-33)
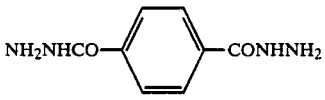
(I-34) $NH_2NHCO-(CH_2)_4-CONHNH_2$
(I-35)
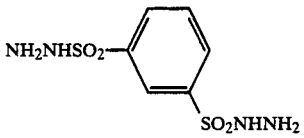
(I-36)
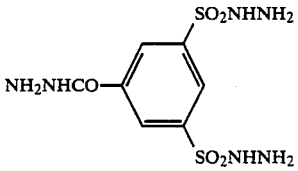
(I-37)
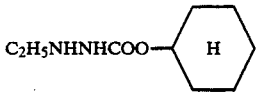
(I-38) $NH_2NHCHO$
(I-39)
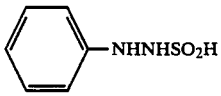
(I-40)
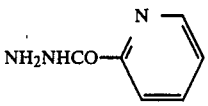
(I-41) $NH_2NHCOOC_2H_4OCONHNH_2$
(I-42) $NH_2NHSO_2OC_3H_7(i)$ -continued (I-43)

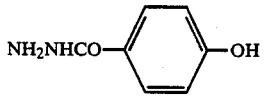

(I-44)

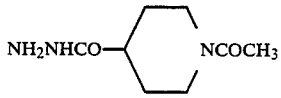

(I-45)

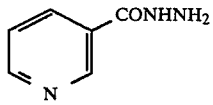

Many of compounds represented by the general formula (I) are available as products on the market, and may be synthesized applying similarly generic synthetic methods disclosed, for example, in Organic Synthesis, Coll. vol. 2, p. 228.

Compounds represented by the general formula (I) may be in the form of salts with various acids such as hydrochloric acid, sulfuric acid, nitric acid, phosphoric acid, oxalic acid or acetic acid.

Amount of a compound of the general formula (I) to be added to a color developing solution is 0.1 to 20 g, preferably 0.5 to 10 g per l of the solution.

Hydrazines represented by the general formula (II) are described in detail below.

General formula (II)

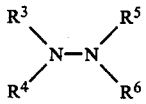

wherein $R^3$, $R^4$, $R^5$ and $R^6$ independently represent a hydrogen atom, a substituted or unsubstituted alkyl group (preferably having 1 to 10 carbon atoms, for example, a methyl, ethyl, hydroxyethyl, cyclohexyl or benzyl group or the like), a substituted or unsubstituted aryl group (preferably having 6 to 10 carbon atoms, for example, a phenyl, 3-hydroxyphenyl or 4-methoxyphenyl group or the like), or a substituted or unsubstituted heterocyclic group (preferably having 1 to 10 carbon atoms, more preferably being 5- or 6-membered ring and containing at least one of oxygen, nitrogen, sulfur and so o as heterocyclic atom(s), for example, a 4-pyridyl on N-acetylpiperidin-4-yl group or the like). $R^3$ and $R^4$, and $R^5$ and $R^6$ may each combine to form a heterocyclic ring.

Preferred examples of group(s) with which $R^3$ to $R^6$ may each further be substituted include halogen atom(s) (chlorine, bromine, etc.), hydroxyl group(s), carboxyl group(s), sulfo group(s), amino group(s), alkoxy group(s), amido group(s), alkane- or arylsulfonamido group(s), carbamoyl group(s), sulfamoyl group(s), alkyl group(s), and aryl group(s), and they may further be substituted.

Preferred examples of $R^3$ to $R^6$ in the general formula (II) include hydrogen atoms, alkyl groups and aryl groups. It is more preferable that $R^3$ and $R^4$ are both hydrogen atoms, and $R^5$ and $R^6$ are hydrogen atoms, alkyl groups or aryl groups. It is most preferable that $R^3$ and $R^4$ are hydrogen atoms, and $R^5$ and $R^6$ are alkyl groups ($R^5$ and $R^6$ may combine to form a heterocyclic ring).

When a compound represented by the general formula (II) is a monomer, the sum of its carbon number is preferably 10 or less, more preferably 2 to 10, and most preferably 2 to 7.

A compound of the general formula (II) may be in the form of a bis compound, a tris compound or a polymer where two or more compounds of the formula (II) are linked through $R^3$, $R^4$, $R^5$ and/or $R^6$.

Specific examples of compounds represented by the general formula (II) are illustrated below, but the invention should not be interpreted to be limited thereto.

(II-1)

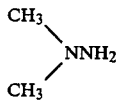

(II-2) $CH_3NHNHCH_3$ (II-3)

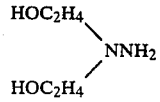

(II-4)

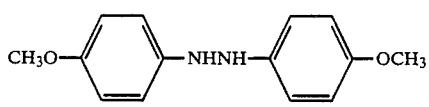

(II-5)

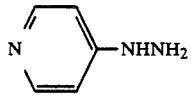

(II-6)

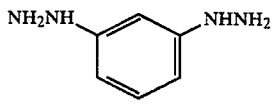

(II-7)

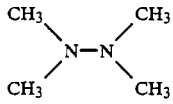

(II-8)

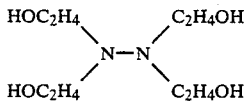

(II-9) $C_2H_5NHNHC_2H_5$ (II-10)

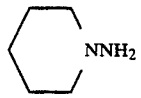

(II-11)

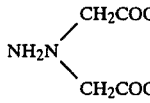

(II-12) $HOOCCH_2NHNHCH_2COOH$ (II-13) $NH_2NH(CH_2)_3NHNH_2$ (II-14)

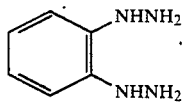

-continued

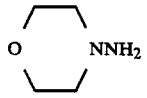
(II-15)

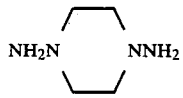
(II-16)

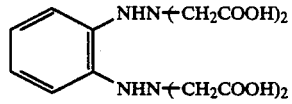
(II-17)

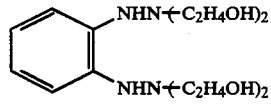
(II-18)

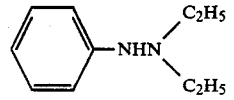
(II-19)

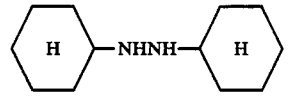
(II-20)

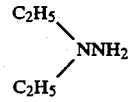
(II-21)

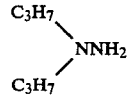
(II-22)

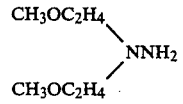
(II-23)

$NH_2NHCH_2CH_2OH$ (II-24)

Many of compounds represented by the general formula (II) are available as products on the market, and may be synthesized applying similarly generic synthetic methods disclosed, for example, in Organic Synthesis, Coll. vol. 2, p.208–213.

Compounds represented by the general formula (II) may be in form of salts with various acids such as tydrochloric acid, sulfuric acid, nitric acid, phosphoric acid, oxalic acid or acetic acid.

Amount of a compound of the general formula (II) to be added to a color developing solution is 0.1 to 20 g, preferably 0.5 to 10 g per 1 l of the solution.

Compounds represented by the general formula (II) are described in more detail below.

General formula (III)

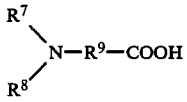

wherein $R^7$ and $R^8$ each represent a hydrogen atom, a substituted or unsubstituted alkyl group (having 1 to 10 carbon atoms, for example, a methyl, ethyl, hydroxyethyl, carboxymethyl, N,N-diethylaminoethyl, methoxypropyl, mesylethyl, butyl or isobutyl group or the like), and $R^9$ represents a substituted or unsubstituted alkylene group (having 1 to 10 carbon atoms, for example, a methylene, ethylene, propylene or 2-hydroxypropylene group or the like). The sum of carbon number of $R^7$, $R^8$ and $R^9$ is 3 or more.

Preferred examples of $R^7$ and $R^8$ in the general formula III) include hydrogen atoms, unsubstituted alkyl groups, hydroxyalkyl groups, alkoxyalkyl groups and carboxyalkyl groups, and it is more preferable that at least one of $R^7$ and $R^8$ is a hydrogen atom, an unsubstituted alkyl group or a hydroxyalkyl group.

Preferred examples or $R^9$ in the general formula (III) include an unsubstituted alkylene group, and an alkylene group substituted with a carboxyl group, an amino (group or a hydroxyl group.

The number of carboxyl group(s) which a compound of the general formula (III) has is 3 or less, preferably 2 or less.

Amount of a compound of the general formula (III) to be added is 0.01 to 50 g, preferably 0.1 to 20 g per 1 l of a color developing solution.

Specific examples of compounds of the general formula (III) usable in the invention are illustrated below, but the invention should not be interpreted to be limited thereto.

$(HOC_2H_4)_2N-CH_2COOH$ (III-1)

$HN(CH_2COOH)_2$ (III-2)

$CH_3N(CH_2COOH)_2$ (III-3)

$H_2N(CH_2)_4CH(NH_2)COOH$ (III-4)

$NH_2CH(C_2H_4COOH)COOH$ (III-5)

$HOC_2H_4-N(CH_2COOH)_2$ (III-6)

$(HOC_2H_4)_2N-(CH_2)_2N(CH_2COOH)_2$ (III-7)

$(CH_3OC_2H_4)_2N(CH_2)_3COOH$ (III-8)

$HOC_2H_4-N(CH(C_2H_5)COOH)_2$ (III-9)

$(HOC_2H_4OC_2H_4)_2N(CH_2)_3COOH$ (III-10)

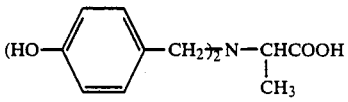
(III-11)

$HOC_2H_4OC_2H_4OC_2H_4-N(C_2H_4COOH)_2$ (III-12)

-continued $C_4H_9NC_2H_4COOH$ (III-13)
$(CH_2)_3SO_3H$ $CH_3SO_2C_2H_4N(CH_2COOH)_2$ (III-14)

$(ClC_2H_4)_2N-CHCH_2COOH$ (III-15)
$CH_3$ (III-16)

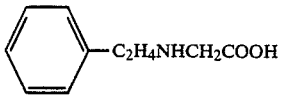

$NH_2(CH_2)_3COOH$ (III-17)

$CH_3NHC_2H_4COOH$ (III-18)

$(CH_3)_2N-CH_2COOH$ (III-19)

$(C_2H_5)_2NCH_2CHCH_2COOH$ (III-20)
OH

Many of compounds of the general formula (III) are available as products on the market, and may also be synthesized according to a generic synthetic method.

Compounds represented by the general formula (IV) are described in detail below.

General formula (IV)

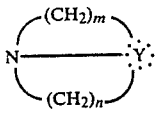

In the general formula (IV), the carbon number of Y is preferably 1 to 20, more preferably 10 or less, and most preferably 6 or less; m is preferably 3 or less, and n is preferably 4 or less.

A compound of the general formula (IV) may be in the form of a bis compound, a tris compound or the like.

Specific examples of Y in the general formula (IV) include

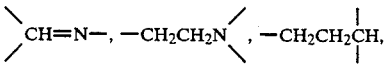

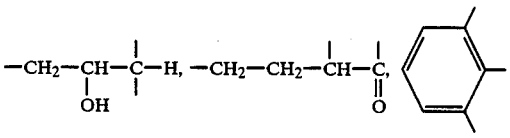

or the like.

Preferred examples of compounds of the general formula (IV) include those represented by the following general formulae (IV-a) and (IV-b).

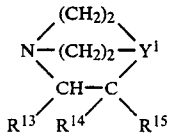

(IV-a)

wherein $Y^1$ represents

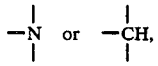

and $R^{13}$, $R^{14}$ and $R^{15}$ each represent a hydrogen atom, a lower alkyl group, a hydroxy-substituted lower alkyl group, a hydroxyl group or an alkoxy group, and $R^{14}$ and $R^{15}$ may alfo combine to form a carbonyl group.

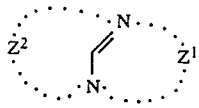

(IV-b)

wherein $Z^1$ and $Z^2$ each represents a methylene chain necessary for forming a heterocycle, and $Z^1$ and $Z^2$ may each have substituent(s) such as hydroxyl group(s) or alkoxy group(s) thereon.

Carbon numbers contained in $Z^1$ and $Z^2$ are each 2 to 8, preferably 3 to 6.

Specific examples of compounds of the general formula (IV) usable in the invention are illustrated below, but the invention should not be interpreted to be limited thereto.

(IV-1)

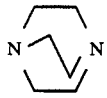

(IV-2)

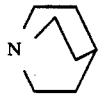

(IV-3)

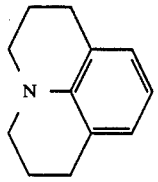

(IV-4)

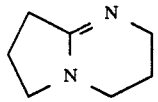

(IV-5)

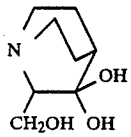

(IV-6)

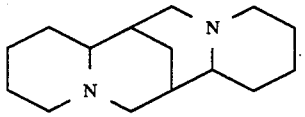

(IV-7)

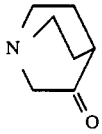

-continued (IV-8)

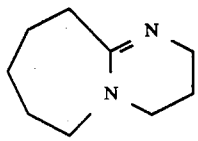

(IV-9)

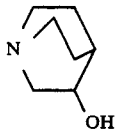

Many of compounds represented by the general formula (IV) are readily available as products on the market, and may also be synthesized according to a generic synthetic method.

Amount of a compound of the general formula (IV) to be added to a color developing solution is preferably 0.1 to 50 g, more preferably 0.2 to 20 g per 1 l of the solution.

When compound(s) to be contained in a color developing solution in the invention is(are) at least one of the compounds represented by the general formulae (I) and (II), it is preferable to make at least one of compounds represented by the formulae (III) and (IV) further contain therein. Each amount of compounds of the formulae (I) to (IV) to be added may be the same as described above.

When compound(s) to be contained in a color developing solution is(are) at least one of the compounds represented by the general formulae (III) and (IV), it is preferable to make at least one of compounds represented by the formulae (V) and (VI) further contain therein.

Compounds represented by the formula (V) or (VI) are described in detail below.

General formula (V)

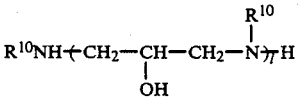

wherein $R^{10}$ represents a hydrogen atom, an alkyl group or an aryl group, and l represents an integer of 2 or more.

The general formula (V) is described in more detail below. In the formula, $R^{10}$ represents a hydrogen atom, an alkyl group or an aryl group. These alkyl and aryl groups may be substituted, and examples of substituent(s) include further optionally substituted, hydroxyl group(s), alkoxy group(s), aryloxy group(s), carboxyl group(s), amino group(s), sulfo group(s), phosphonic acid group(s), alkane- or arylsulfonyl group(s), ureido group(s) acyl group(s), alkylthio group(s), arylthio group(s), carbamoyl group(s), sulfamoyl group(s), acylamino group(s), alkane- or arylsulfonamido group(s), halogen atom(s), vinyl group(s), cyano group(s), nitro group(s) and the like. Such an alkyl group or an aryl group may be substituted with two or more, or two kinds or more of these substituents. Carboxyl group(s), phosphonic acid group(s) and sulfo group(s) among functional groups contained in the formula may be in the form of salt with an alkali metal such as sodium or potassium. Further, l represents an integer of 2 or more, preferably 2 to 1,000, more preferably 2 to 100.

Further, a compound of the general formula (V) may be in the form of a salt with one of various acids such as hydrochloric acid, sulfuric acid, nitric acid, phosphoric acid, oxalic acid and acetic acid.

Preferred examples of $R^{10}$ in the general formula (V) include a hydrogen atom, a substituted or unsubstituted alkyl group. Preferred examples of substituent(s) of this alkyl group include hydroxyl group(s), alkoxy group(s), carboxyl group(s), sulfo group(s) and phosphonic acid group(s).

A compound of the general formula (V) may be a compound having both following repeating units of (V-A) and (V-B).

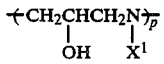

(V-A)

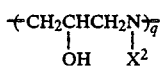

(V-B)

wherein p and q each represent an integer of 1 to 2,000,000, preferably 1 to 1,000,000, and $X^1$ and $X^2$ are different but each have the same meaning with $R^{10}$ and in this case it is preferable that one of $X^1$ and $X^2$ is a hydrogen atom.

Total carbon number of $R^{10}$ in the general formula (V) (average carbon number of carbon number of $X^1$ and carbon number of $X^2$ when the general formula (V) consists of a mixture of (V-A) and (V-B)) is preferably 10 or less, and more preferably 5 or less.

Amount of a compound represented by the general formula (V) to be added is preferably 0.01 to 50 g, more preferably 0.01 to 20 g per 1 l of a color developing solution.

Specific examples of compounds of the general formula (V) are illustrated below, but the invention should not be interpreted to be limited thereto.

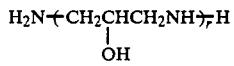

(V-1)

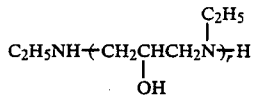

(V-2)

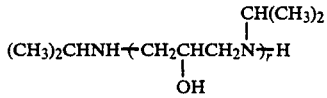

(V-3)

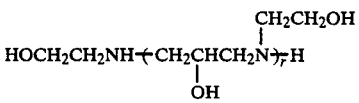

(V-4)

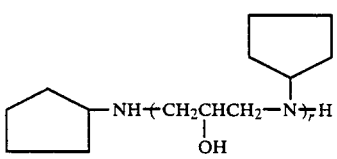

(V-5)

-continued

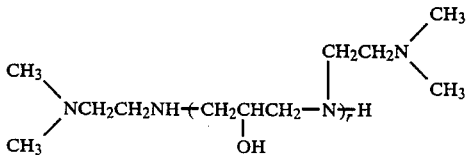
(V-6)

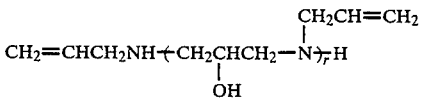
(V-7)

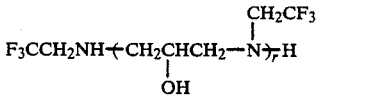
(V-8)

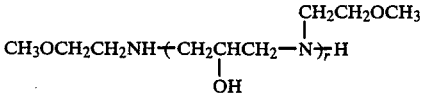
(V-9)

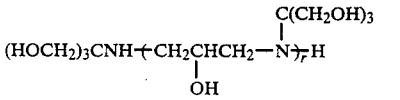
(V-10)

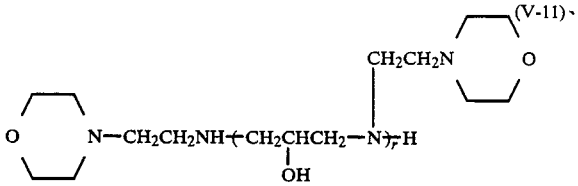
(V-11)

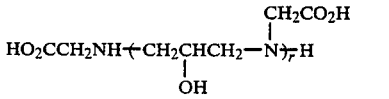
(V-12)

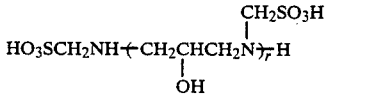
(V-13)

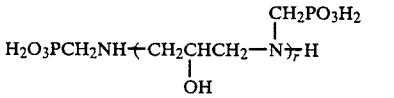
(V-14)

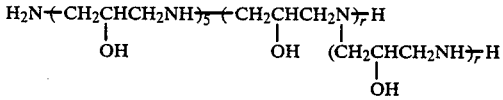
(V-15)

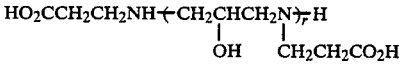
(V-16)

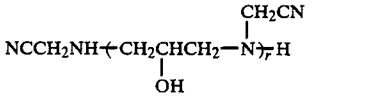
(V-17)

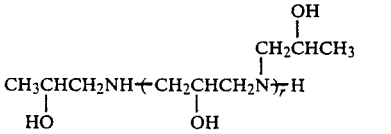
(V-18)

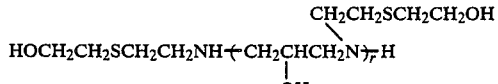
(V-19)

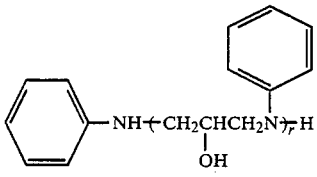
(V-20)

Compounds of the general formula (V) may generally be synthesized according to the following synthetic example.

SYNTHETIC EXAMPLE 1 (SYNTHESIS OF EXEMPLIFIED COMPOUND (V-1))

40 ml (0.5 mol) of epichlorohydrin and 40 ml (0.6 mol) of 29% ammonia water were stirred at room temperature for 2 hours, and then water was completely distilled away to obtain 56 g of colorless gel-like poly(2-hydroxy-1-iminopropylene)hydrochloride

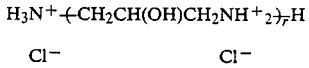

r was about 100).

As $C_3H_8ClNO$

| | | | |
|---|---|---|---|
| Found | C ; 32.60 | H ; 7.66 | N ; 12.49 |
| Calculated | C ; 32.89 | H ; 7.36 | N ; 12.79 |

General formula (VI)

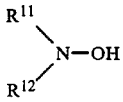

wherein $R^{11}$ and $R^{12}$ each represent a hydrogen atom, an unsubstituted or substituted alkyl group, an unsubstituted or substituted alkenyl group, or an unsubstituted or substituted aryl group. It is preferable that $R^{11}$ and $R^{12}$ are not hydrogen atoms at the same time.

It is preferable that $R^{11}$ and $R^{12}$ are alkyl groups or alkenyl groups, and it is further preferable that at least one of them has a substituent. Further, $R^{11}$ and $R^{12}$ may combine to form a heterocycle together with the nitrogen atom.

The alkyl and alkenyl groups may be any of straight chained, branched chained and cyclic groups.

Examples of the substituent(s) referred to in the definition of $R^{11}$ and $R^{12}$ include halogen atom(s) (F, Cl, Br, etc.), optionally substituted aryl group(s) (phenyl group(s), p-chlorophenyl group(s), etc.), optionally substituted alkoxy group(s) (methoxy group(s), ethoxy group(s), methoxyethoxy group(s), etc.), aryloxy group(s) (phenoxy group(s), etc.), alkane- or arylsulfonyl group(s) (methanesulfonyl group(s), p-toluenesulfonyl group(s), etc.), alkane- or arylsulfonamide group(s) (methanesulfonamido group(s), benzenesulfonamido group(s), etc.), optionally substituted sulfamoyl group(s) (diethylsulfamoyl group(s), sulfamoyl group(s), etc.), optionally substituted carbamoyl group(s) (carbamoyl group(s), diethylcarbamoyl group(s), etc.), amido group(s) (acetamido group(s), benzamido group(s), etc.), optionally substituted ureido group(s) (methylureido group(s), phenylureido group(s), etc.), alkoxycarbomylamino group(s) (methoxycarbonylamino group(s), etc.), aryloxycarbonylamino group(s) (phenoxycarbonylamino group(s), etc.), alkoxycarbonyl group(s) (methoxycarbonyl group(s), etc.), aryloxycarbonyl group(s) (phenoxycarbonyl group(s), etc.), cyano group(s), hydroxy group(s), carboxyl group(s), sulfo group(s), nitro group(s), optionally substituted amino group(s) (amino group(s), diethylamino group(s) etc.), alkylthio group(s) (methythio group(s), etc.), arylthio group(s) (phenylthio group(s), etc.) and heterocyclic group(s) (morpholino group(s), pyridyl group(s), etc.). $R^{11}$ and $R^{12}$ may be the same or different, and substituent(s) of $R^{11}$ and substituent(s) of $R^{12}$ may also be the same or different.

Carbon numbers of $R^{11}$ and $R^{12}$ are each preferably 1 to 10, particularly 1 to 5. Examples of a nitrogen-containing heterocycle formed by combination of $R^{11}$ and $R^{12}$ include a piperidino group, a pyrrolidino group, an N-alkylpiperazino group, a morpholino group, 1-indolinyl group, a benzotriazolyl group, etc.

Preferred examples of the substituent(s) referred to in the definition of $R^{11}$ and $R^{12}$ include hydroxy group(s), optionally substituted alkoxy group(s), alkane- or arylsulfonyl group(s), amido group(s), carboxyl group(s), cyano group(s), sulfo group(s), nitro group(s) and optionally substituted amino group(s).

Specific examples of compounds represented by the general formula (VI) as used in the invention are illustrated below, but the invention should not be interpreted to be limited thereto.

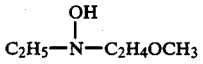
(VI-1)

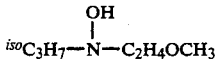
(VI-2)

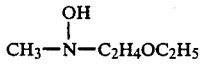
(VI-3)

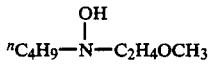
(VI-4)

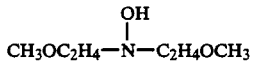
(VI-5)

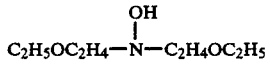
(VI-6)

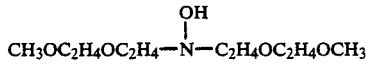
(VI-7)

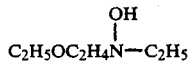
(VI-8)

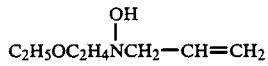
(VI-9)

-continued

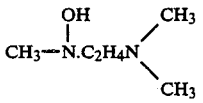
(VI-10)

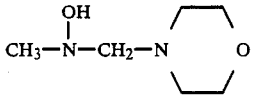
(VI-11)

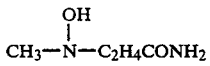
(VI-12)

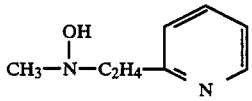
(VI-13)

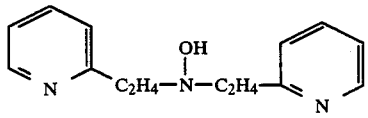
(VI-14)

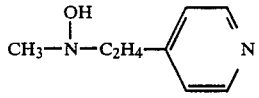
(VI-15)

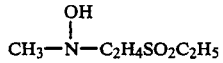
(VI-16)

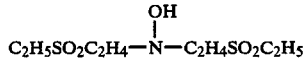
(VI-17)

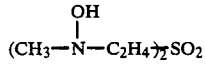
(VI-18)

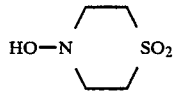
(VI-19)

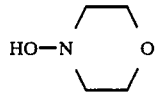
(VI-20)

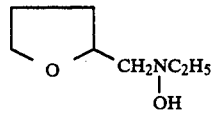
(VI-21)

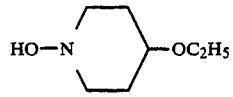
(VI-22)

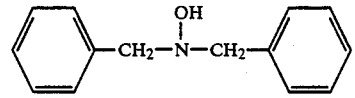
(VI-23)

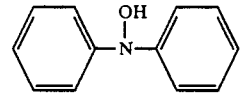
(VI-24)

-continued

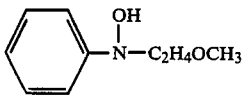
(VI-25)

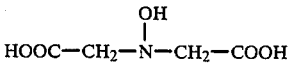
(VI-26)

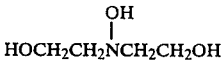
(VI-27)

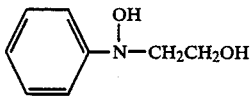
(VI-28)

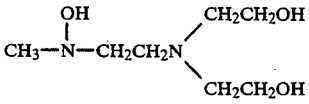
(VI-29)

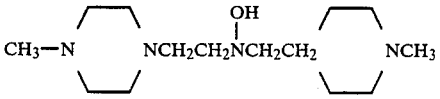
(VI-30)

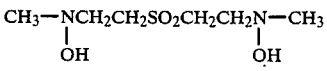
(VI-31)

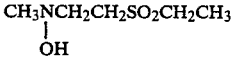
(VI-32)

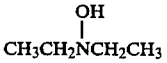
(VI-33)

Compounds represented by the general formula (VI) may be synthesized according to the following known methods: U.S. Pat. Nos. 3,661,996, 3,362,961 and 3,293,034, J.P. KOKOKU No. 42-2794, U.S. Pat. Nos. 3,491,151, 3,655,764, 3,467,711, 3,455,916, 3,287,125 and 3,287,124.

These compounds may be in the form of salts with various acids such as hydrochloric acid, sulfuric acid, nitric acid, phosphoric acid, oxalic acid and acetic acid.

Amount of a compound of the general formula (VI) to be added to a color developing solution is preferably 0.1 to 20 g, more preferably 0.5 to 10 g per 1 l of the color developing solution.

Internal latent image type emulsions which have not previously been fogged as usable in the invention include those disclosed in page 28, line 14 to page 31, line 2 of the specification of Japanese Patent Application No. 61-253716 filed on Oct. 27, 1986 (Application: FUJI PHOTO FILM CO., LTD.), and silver halide grains usable in the invention include those disclosed in page 31, line 3 to page 32, line 11 of the above specification, and particularly silver chlorobromide and silver halide are preferable.

Light fog exposure applicable to the invention may be conducted according to methods disclosed in page 45, line 17 to page 49, line 5 of the above specification.

Nucleating agents usable in the invention include those disclosed in page 49, line 6 to page 67, line 2 of the above specification, and particularly compounds represented by the general formulae [N-1] and [N-2] are preferably used. Preferred examples of the nucleating agents include compounds of the following [N-I-1] to [N-I-20] and [N-II-1] to [N-II-14].

[N-I-1]:5-Ethoxy-2-methyl-1-propargylquinolinium bromide

[N-I-2]:2,4-Dimethyl-1-propargylquinolinium bromide

[N-I-3]:2-Methyl-1-{3-[2-(4-methylphenyl)hydrazono]-butyl}quinolinium iodide

[N-I-4]:3,4-Dimethyl-dihydropyrido[2,1-b]benzo-thiazolium bromide

[N-I-5]:6-Ethoxythiocarbonylamino-2-methyl-1-propargylquinolinium trifluoromethanesulfonate

[N-I-6]:2-Methyl-6-(3-phenylthioureido)-1-propargyl-quinolinium bromide

[N-I-7]:6-(5-Benzotriazolecarboxamido)-2-methyl-1-propargylquinolinium trifluoromethansulfonate

[N-I-8]:6-[3-(2-Mercaptoethyl)ureido]-2-methyl-1-propargylquinolinium trifluoromethanesulfonate

[N-I-9]:6-{3-[3-(5-Mercapto-thiaziazol-2-ylthio)-propyl]ureido}-2-methyl-1-propargylquinolinium trifluoromethanesulfonate

[N-I-10]:6-(5-Mercaptotetrazol-1-yl)-2-methyl-1-propargylquinolinium iodide

[N-I-11]:1-Propargyl-2-(1-porpenyl)quinolinium trifluoromethanesulfonate

[N-I-12]:6-Ethoxythiocarbonylamino-2-(2-methyl-1-propenyl)-2-propargylquinolinium trifluoromethane-sulfonate

[N-I-13]:10-Propargyl-1,2,3,4-tetrahydroacridinium tri-fluoromethanesulfonate

[N-I-14]:7-Ethoxythiocarbonylamino-10-propargyl-1,2,3,4-tetrahydroacridinium trifluoromethanesulfo-nate

[N-I-15]:6-Ethoxythiocarbonylamino-1-propargyl-2,3-pentamethylenequinolinium trifluoromethanesulfo-nate

[N-I-16]:7-[3-(5-Mercaptotetrazol-1-yl)benzamino]-10-propargyl-1,2,3,4-tetrahydroacridinium perchlorate

[N-I-17]: 6-[3-(5-Mercaptotetrazol-1-yl)benzamido]-1-propargyl-2,3-pentamethylenequinolinium bromide

[N-I-18]: 7-(5-Mercaptotetrazol-1-yl)-9-methyl-10-propargyl-1,2,3,4-tetrahydroacridinium bromide

[N-I-19]: 7-[3-{N-[2-(5-mercapto-1,3,4-thiadiazol-2-yl)e-thyl]carbamoyl}propaneamido-10-propargyl-1,2,3,4-tetrahydroacridinium]iodide

[N-I-20]: 6-(5-Mercaptotetrazol-1-yl)-4-methyl-1-propargyl-2,3-pentamethylenequinolinium bromide

[N-II-1]: 1-Formyl-2-{4-[3-(2-methoxyphenyl)ureido]-phenyl}hydrazine

N-II-2]: 1-Formyl-2-{4-[3-{3-[3-(2,4-di-tertpentyl-phenoxy)propyl]ureido}-phenylsulfonylamino]-phenyl}hydrazine

[N-II-3]: 1-Formyl-2-{4-[3-(5-mercaptotetrazol-1-yl)benzamido]phenyl}hydrazine

[N-II-4]: 1-Formyl-2-[4-{3-[3-(5-mercaptotetrazol-1-yl)phenyl]ureido}phenyl]hydrazine

[N-II-5]: 1-Formyl-2-[4-{3-[N-(5-mercapto-4-methyl-1,2,4-triazol-3-yl)carbamoyl]propaneamido}phenyl]-hydrazine

[N-II-6]: 1-Formyl-2-{4-[3-{N-[4-(3-mercapto-1,2,4-triazol-4-yl)phenyl]carbamoyl}-propaneamido]-phenyl}hydrazine

[N-II-7]: 1-Formyl-2-[4-{3- [N-(5-mercapto-1,3,4-thiadiazol-2-yl)carbamoyl]-propaneamido}phenyl]-hydrazine

[N-II-8]: 2-[4-(Benzotriazole-t-carboxamido)phenyl]-1-formylhydrazine

[N-II-9]: 2-[4-{3-[N-(benzotriazole-5-carboxamido) carbamoyl]propaneamido}phenyl]-1-formylhydrazine

[N-II-10]: 1-Formyl-2-{4-[1-(N-phenylcarbamoyl)thiosemicarbazido]phenyl}hydrazine

[N-II-11]: 1-Formyl-2-{4-[3-(3-phenylthioureido)benzamido]phenyl}hydrazine

[N-II-12]: 1-Formyl-2-[4-(3-hexylureido)phenyl]hydrazine

[N-II-13]: 1-Formyl-2-{4-[3-(5-mercaptotetrazol-1-yl)benzenesulfonamido]phenyl}hydrazine

[N-II-14]: 1-Formyl-2-{4-[3-{3-[3-(5-mercaptotetrazol-1-yl) phenyl]ureido]benzenesulfonamido]phenyl}hydrazine Examples of a nucleation accelerator used in the invention include compounds (A-1) to (A-13) disclosed in pages 69 and 70 of the above-mentioned specification. Further, examples of magenta couplers, cyan couplers and yellow couplers include those disclosed in page 48, line 14 to page 57 of the specification of Japanese Patent Application No. 61-286367.

Examples of a color developing solution usable in developing process of a light-sensitive material in the invention include those disclosed in page 71, line 4 to page 72, line 9 of the specification of Japanese Patent Application No. 61-253716. Preferred example of aromatic primary amine series color developing agents include p-phenylenediamine series compounds, and specific examples thereof include 3-methyl-4-amino-N-ethyl-N-(β-methanesulfonamidoethyl)aniline, 3-methyl-4-amino-N-ethyl-N-(β-hydroxyethyl)aniline, 3-methyl-4-amino-N-ethyl-N-methoxyethylaniline and their salts such as sulfate and hydrochloride. Developing process of the invention may be carried out at pH 11.5 or less, preferably at pH 11.0 to 10.0. Further, it is preferable that the developing solution of the invention does not substantially contain benzyl alcohol.

It is preferable that a color developing solution used in the method of the invention contains at least one selected from the following compound group A.

(Compound group A)

Ethylenediaminetetramethylenephosphonic acid,
1-Hydroxyethylidene-1, 1-diphosphonic acid,
Cyclohexanediaminetetraacetic acid,
Diethylenetriaminepentaacetic acid,
Triethylenetetraaminehexaacetic acid,
Diethylenetriaminepentamethylenephosphonic acid,
Triethylenetetraaminehexamethylenephosphonic acid,
Nitrilo-N,N,N-triacetic acid,
Nitrilo-N,N,N,-trimethylenephosphonic acid,
Diaminopropanoltetraacetic acid,
1,2,4-Tricarboxy-2-butanephosphonic acid,
5-Sulfosalicylic acid,
and alkali metal salts or alkaline earth metal salts of each of the above compounds.

The compound of the group A may be contained in a color developing solution in an amount of $1\times10^{-4}$ - $1\times10^{-1}$ mole, preferably $1\times10^{-3}$ - $1\times10^{-1}$ mole per liter of the developing solutions.

Iron ion concentration in a color developing solution used in the invention is preferably $5\times10^{-4}$ g or less per 1 l of the color developing solution from the viewpoint of coloring property of the solution.

The photographic emulsion layers after color development are usually subjected to bleach process. Bleaching process may be conducted by single bath bleach-fixing process, i.e. together with fixing process, or both processes may individually be conducted. Further, for rapid processing, a process method where bleach-fixing process is conducted after bleaching process, or a method where bleach-fixing process is conducted after bleaching process may also be adopted. An iron complex salt of aminopolycarboxylic acid is usually used in a bleaching solution or a bleach-fixing solution of the invention as a bleaching agent. Examples of additives used in a bleaching solution or a bleach-fixing solution of the invention may include various compounds disclosed in pages 22 to 30 of the specification of Japanese Patent Application No. 61-32462. Processes such as water washing and/or stabilization are conducted after desilver step (i.e., bleach-fixing or fixing). Water subjected to water-softening process is preferably used for water for water washing or for stabilizing solutions. Examples of method for water-softening process include a method using an ion exchange resin or a reverse osmosis equipment disclosed in the specification of Japanese Patent Application No. 61-131632. Further, as a preferred specific method therefor a method disclosed in the specification of Japanese Patent Application No. 61-131632 may be adopted.

Further, examples of additives used in water washing and stabilization steps may include various compounds disclosed in pages 30 to 36 of the specification of Japanese Patent Application No. 61-32462.

It is preferable that amount of replenisher in each step is small. Amount of replenisher is preferably 0.1 to 50 times, more preferably 3 to 30 times the amount carried in from the pre-bath per the unit area of the light-sensitive material.

The invention is exemplified below by examples, but the invention should not be interpreted to be limited thereto.

EXAMPLE 1

(1) Preparation of an emulsion

Emulsion A

A mixed aqueous solution of potassium bromide and sodium chloride and an aqueous silver nitrate solution were simultaneously added to an aqueous gelatin solution to which 0.5 g of 3,4-dimethyl-1,3-thiazoline-2-thione was added per 1 mole of Ag with vigorous stirring at 65° C. over a period of about 5 minutes to obtain a monodispersed silver chlorobromide emulsion containing silver chlorobromide grains having an average grain size of about 0.3 μm (silver bromide content 40 mole %). Then, 35 mg of sodium thiosulfate, 20 mg of chloroauric acid (tetrahydrate) and $4\times10^{-5}$ moles of lead acetate (trihydrate) were added to the emulsion per 1 mole of silver, and the mixture was heated at 60° C. for 60 minutes to conduct chemical sensitization.

The thus obtained silver chlorobromide grains as cores were placed in the same precipitation environment as that in the first treatment for further 50 minutes to grow them, and finally an emulsion of a monodispersed core/shell silver chlorobromide (silver bromide content 40 mole %) having an average grain size of 0.6 μm was obtained. Variation coefficient of grain size was about 10%.

After water washing and desalting, 3 mg of sodium thiosulfate and 3.5 mg of chloroauric acid (tetrahydrate) per 1 mole of silver were added to the emulsion, and the mixture was heated at 60° C. for 50 minutes to conduct chemical sensitization, whereby internal latent image type silver halide (cube) emulsion A was obtained.

(2) Preparation of a photographic light-sensitive material

A photographic light-sensitive material having the following layer construction was prepared.

| | |
|---|---|
| The E 9th layer | Protective layer |
| The E 8th layer | Ultraviolet absorbing layer |
| The E 7th layer | Blue-sensitive emulsion layer |
| The E 6th layer | Intermediate layer |
| The E 5th layer | Yellow filter layer |
| The E 4th layer | Intermediate layer |
| The E 3rd layer | Green-sensitive emulsion layer |
| The E 2nd layer | Intermediate layer |
| The E 1st layer | Red-sensitive emulsion layer |
| Support | |
| The B 1st layer | Curling-inhibiting layer |
| The B 2nd layer | Protective layer |

Coating solutions were prepared as follows. Preparation of a coating solution for the E 1st layer First, 40 cc of ethyl acetate and 7.7 cc of a solvent (ExS-1) were added to 13.4 g of a cyan coupler (ExCC-1), 5.7 g or an image stabilizer (ExSA-1) and 10.7 g of a polymer (ExP-1) to make a solution, and the solution was emulsified and dispersed in 185 cc of an aqueous 10% gelatin solution containing 8 cc of 10% sodium dodecylbenzenesulfonate. On the other hand, the internal latent image type emulsion containing 63 g/kg Ag) to which the red-sensitive sensitizing dye shown below was added in an amount of $2.5\times10^{-4}$ mols per 1 mole of silver was prepared. The aforementioned emulsified dispersion and this emulsion were mixed to make a solution, and adjustment was conducted so that the composition of the solution becomes that shown below to prepare a coating solution for the 1st layer.

Coating solution for the E 2nd layer to the E 9th layer and for the B 1st and B 2nd layers were prepared in a manner similar in the coating solution for the E 1st layer. As a gelatin hardener for each layer was used sodium salt of 1-oxy-3,5-dichloro-s-triazine.

The following compounds were used as a spectral sensitizing agent for respective layers.

Red-sensitive emulsion layer

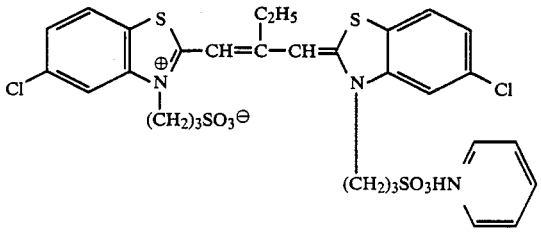

($2.5\times10^{-4}$ mole per 1 mole of silver halide)

Green-sensitive emulsion layer

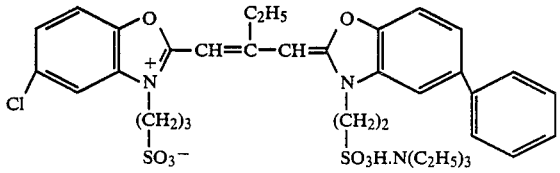

($3.1\times10^{-4}$ mole per 1 mole of silver halide)

Blue-sensitive emulsion layer

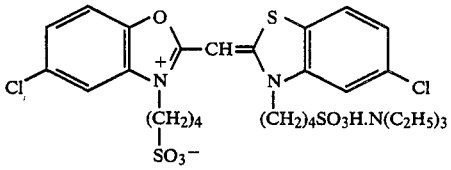

($4.3\times10^{-4}$ mole per 1 mole of silver halide)

The following dyestuffs were used as irradiation-inhibiting dyestuffs.

Irradiation-inhibiting dyestuff for the free-sensitive emulsion layer

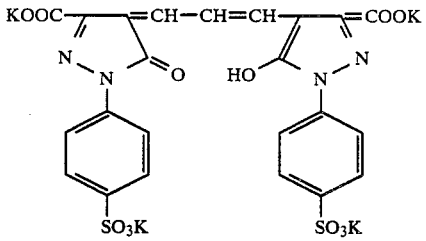

Irradiation-inhibiting dyestuff for the res-sensitive emulsion layer

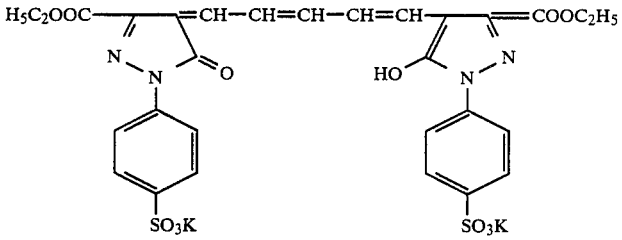

(Layer Construction)

Composition of each layer is shown below. Figures represent amount applied per $m^2$. As for the silver halide emulsion and colloidal silver figures represent applied amount in terms of silver amount.

Support

Polyethylene-laminated paper

Polyethylene on the E 1st layer side contains a white pigment ($TiO_2$) and a bluish dyestuff (ultramarine)

| The E 1st layer | |
|---|---|
| Silver halide emulsion A | 0.39 g |
| Gelatin | 1.35 g |
| Cyan dye-forming coupler (ExCC-1) | 0.40 g |
| Dye image stabilizer (ExSA-1) | 0.17 g |
| Polymer (ExP-1) | 0.32 g |
| Solvent (ExS-1) | 0.23 g |
| Development-adjusting agent (ExGC-1) | 32 mg |

-continued

| | |
|---|---|
| Stabilizer (ExA-1) | 5.8 mg |
| Nucleation accelerator (ExZS-1) | 0.37 mg |
| Nucleating agent (ExZK-1) | 9.9 μg |
| The E 2nd layer | |
| Gelatin | 1.6 g |
| Ultraviolet absorber (ExUV-1) | 0.62 g |
| Color mixing inhibitor (ExKB-1) | 0.06 g |
| Solvent (ExS-2) | 0.24 g |
| The E 3rd layer | |
| Silver halide emulsion A | 0.27 g |
| Gelatin | 1.79 g |
| Magenta dye-forming coupler (ExMC-1) | 0.32 g |
| Dye image stabilizer (ExSA-2) | 0.20 g |
| Solvent (ExS-3) | 0.65 g |
| Development-adjusting agent (ExGC-1) | 22 mg |
| Stabilizer (ExA-1) | 4 mg |
| Nucleation accelerator (ExZS-1) | 0.26 mg |
| Nucleating agent (ExZK-1) | 3.4 μg |
| The E 4th layer | |
| Gelatin | 0.53 g |
| Ultraviolet absorber (ExUV-1) | 0.21 g |
| Color mixing inhibitor (ExKB-2) | 0.02 g |
| Solvent (ExS-2) | 0.08 g |
| The E 5th layer | |
| Colloidal silver | 0.10 g |
| Gelatin | 0.53 g |
| Ultraviolet absorber (ExUV-1) | 0.21 g |
| Color mixing inhibitor (ExKB-2) | 0.02 g |
| Solvent (ExS-2) | 0.08 g |
| The E 6th layer | |
| The same with the E 4th layer | |
| The E 7th layer | |
| Silver halide emulsion A | 0.26 g |
| Gelatin | 1.83 g |
| Yellow dye-forming coupler (ExYC-1) | 0.83 g |
| Dye image stabilizer (ExSA-3) | 0.19 g |
| Solvent (ExS-4) | 0.35 g |
| Development-adjusting agent (ExGC-1) | 32 mg |
| Stabilizer (ExA-1) | 2.9 mg |
| Nucleation accelerator (ExZS-1) | 0.2 mg |
| Nucleating agent (ExZK-1) | 2.5 μg |
| The E 8th layer | |
| Gelatin | 0.53 g |
| Ultraviolet absorber (UV-1) | 0.21 g |
| Solvent (ExS-5) | 0.08 g |
| The E 9th layer | |

-continued

| | |
|---|---|
| Gelatin | 1.33 g |
| Acryl-modified copolymer of polyvinyl alcohol (modification degree 17%) | 0.17 g |
| Liquid paraffin | 0.03 g |
| Latex grains of polymethyl methacrylate (average grain size 2.8 μm) | 0.05 g |
| The B lst layer | |
| Gelatin | 8.7 g |
| The B 2nd layer | |
| The same with the E 9th layer | |

(ExCC-1) Cyan dye-forming coupler

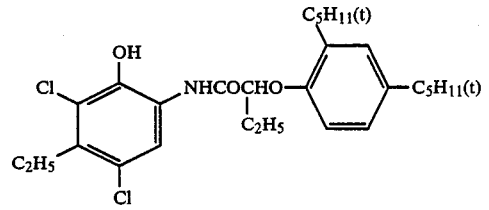

(ExMC-1) Magenta dye-forming coupler

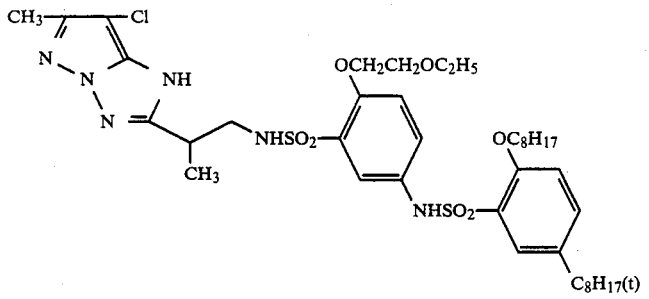

(ExYC-1) Yellow dye-forming coupler

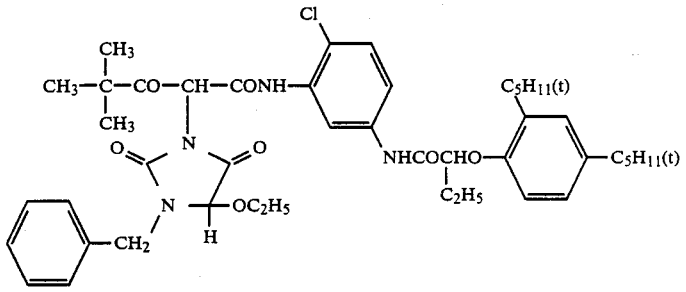

(EXSA-1) Dye image stabilizer
A mixture 5:8:9 (weight ratio) of

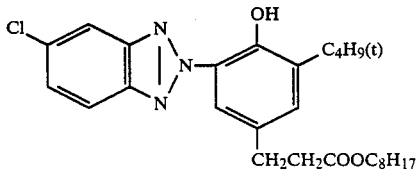

-continued
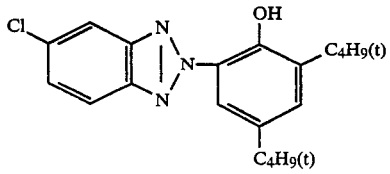
and
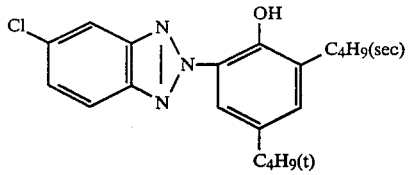
(EXSA-2) Dye image stabilizer
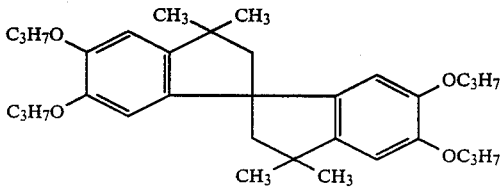
(ExSA-3) Dye image stabilizer
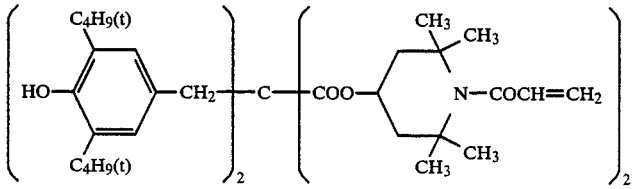
(ExP-1) polyer
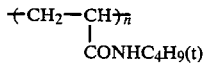
Average molecular weight 80,000
(ExS-1) Solvent
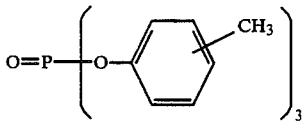
(ExS-2) Solvent
(ExS-3) Solvent
A mixture in 2:1 (volume ratio) of
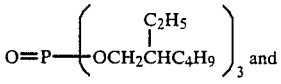
-continued
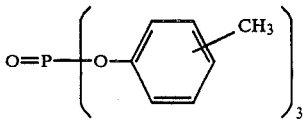
(ExS-4) Solvent
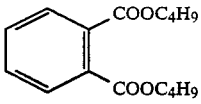
(ExS-5) Solvent
A mixture in 2:1 (volume ratio) of
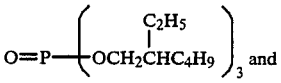
and
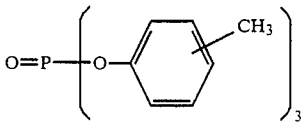
(ExUv-1) Ultraviolet absorber
A mixture in 2:9:8 (weight ratio) of
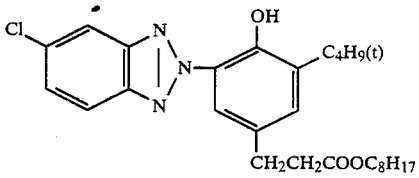
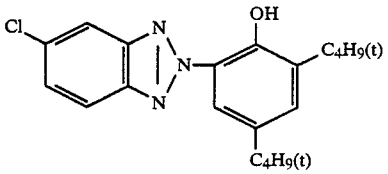
and
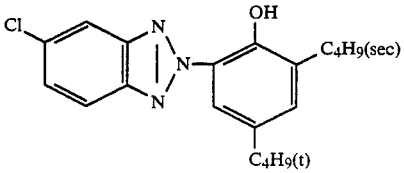
(ExKB-1) Color mixing inhibitor

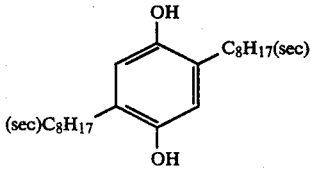

(ExKB-2) Color mixing inhibitor

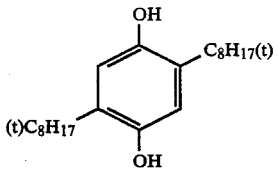

(ExGC-1) Development adjusting agent

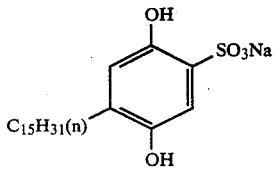

(ExA-1) Stabilixer

4-Hydroxy-6-methyl-1,3,3a,7-tetrazaindene (ExZS-1) Nucleation accelerator 2-(3-Dimethylaminopropylthio)-5-mercapto-1,3,4-thiadiazole hydrochloride (ExZK-1) Nucleating agent 6-Ethoxythiocarbonylamino-2-methyl-1-propargylquinolinium trifluoromethanesulfonate The thus prepared color photographic light-sensitive material 101 was subjected to wedge exposure to light (1/10 seconds, 10 CMS) and then subjected to the following processing steps, and color density of the formed image was determined.

| Process steps A | Time | Temperature |
|---|---|---|
| Color development | 120 sec. | 37° C. |
| Bleach-fixing | 40 sec. | 37° C. |
| Stabilization① | 30 sec. | 37° C. |
| Stabilization② | 30 sec. | 37° C. |

As a method for replenishing the stabilizing bath, a so-called counterflow replenishment method was adopted where the stabilizing bath ② was replenished with a replenisher and an overflow solution of the stabilizing bath ② was let to the stabilizing bath ①.

| (Color developing solution) | Mother liquor |
|---|---|
| Diethylenetriaminepentaacetic acid | 2.0 g |
| Benzyl alcohol | 12.8 g |
| Diethylene glycol | 3.4 g |
| Sodium sulfite | 2.0 g |
| Sodium bromide | 0.26 g |
| Hydroxylamine sulfate | 2.60 g |
| Sodium chloride | 3.20 g |
| 3-Methyl-4-amino-N-ethyl-N-(β-methanesulfonamidoethyl)-aniline | 4.25 g |
| Potassium carbonate | 30.0 g |
| Fluorescent whitener (stilbene series) | 1.0 g |
| Water | to 1,000 ml |
| pH | 10.20 |
| pH was adjusted with potassium hydroxide or hydrochloric acid. | |
| (Bleach-fixing solution) | |
| Ammonium thiosulfate | 110 g |
| Sodium bisultite | 10 g |
| Ammonium (ethylenediaminetetraacetato) iron (III) monohydrate | 56 g |
| Disodium ethylenediaminetetraacetate dihydrate | 5 g |
| 2-Mercapto-1,3,4-triazole | 0.5 g |
| Water | to 1,000 ml |
| pH | 6.5 |

pH was adjusted with ammonia water or with hydrochloric acid.

For the stabilizing bath (water for water washing)

City water was passed through a mixed bed type column packed with an H type strongly acidic cation exchange regin (Diaion SK-1B manufactured by Mitsubishi Chemical Industries Ltd.) and an OH type strongly basic anion exchange regin (Diaion SA-10A manufactured by Mitsubishi Chemical Industries Ltd.) to make it the following water quality. Then, 20 mg/l of sodium dichloroisocyanurate was added as a disinfectant.

Calcium ion: 1.1 mg/l

Magnesium ion: 0.5 mg/l pH: 6.9

The color photographic light-sensitive material 101 was processed in the same manner as above described except using a color developing solution wherein compounds shown in Table 1 were used in place of sodium sulfite and hydroxylamine sulfate in the same moles with the latter.

Maximum density (Dmax) and minimum density (Dmin) of cyan, magenta and yellow of the light-sensitive materials after processing were determined. The results are shown in Table 1.

TABLE 1

| No. | Preservative for the color developing solution: Alternative to sodium sulfite | Preservative for the color developing solution: Alternative of hydroxylamine sulfate | Minimum density (Dmin): Yellow | Minimum density (Dmin): Magenta | Minimum density (Dmin): Cyan | Maximum density (Dmax): Yellow | Maximum density (Dmax): Magenta | Maximum density (Dmax): Cyan | |
|---|---|---|---|---|---|---|---|---|---|
| 1 | Sodium sulfite | Hydroxylamine sulfate | 0.35 | 0.22 | 0.41 | 1.80 | 1.85 | 1.73 | Comparative example |
| 2 | " | Exemplified compound (I-4) | 0.23 | 0.17 | 0.32 | 1.95 | 1.99 | 1.88 | Present invention |
| 3 | " | Exemplified compound (I-11) | 0.24 | 0.18 | 0.31 | 1.93 | 2.00 | 1.86 | Present invention |
| 4 | " | Exemplified compound (I-27) | 0.23 | 0.18 | 0.31 | 1.93 | 2.01 | 1.87 | Present invention |
| 5 | " | Exemplified compound (I-43) | 0.22 | 0.17 | 0.30 | 1.92 | 1.99 | 1.84 | Present invention |
| 6 | " | Exemplified | 0.23 | 0.16 | 0.31 | 1.92 | 2.02 | 1.85 | Present |

TABLE 1-continued

| No. | Preservative for the color developing solution: Alternative to sodium sulfite | Preservative for the color developing solution: Alternative of hydroxylamine sulfate | Minimum density (Dmin) Yellow | Minimum density (Dmin) Magenta | Minimum density (Dmin) Cyan | Maximum density (Dmax) Yellow | Maximum density (Dmax) Magenta | Maximum density (Dmax) Cyan | |
|---|---|---|---|---|---|---|---|---|---|
| | | compound (II-3) | | | | | | | invention |
| 7 | " | Exemplified compound (II-15) | 0.24 | 0.18 | 0.32 | 1.91 | 2.00 | 1.88 | Present invention |
| 8 | " | Exemplified compound (II-24) | 0.23 | 0.18 | 0.32 | 1.94 | 2.03 | 1.86 | Present invention |
| 9 | Exemplified compound (III-5) | Exemplified compound (I-4) | 0.16 | 0.15 | 0.15 | 2.12 | 2.10 | 2.00 | Present invention |
| 10 | Exemplified compound (III-5) | Exemplified compound (I-11) | 0.17 | 0.15 | 0.14 | 2.10 | 2.08 | 1.98 | Present invention |
| 11 | Exemplified compound (III-5) | Exemplified compound (I-27) | 0.16 | 0.14 | 0.14 | 2.11 | 2.10 | 1.99 | Present invention |
| 12 | Exemplified compound (III-5) | Exemplified compound (I-43) | 0.17 | 0.16 | 0.14 | 2.13 | 2.09 | 1.98 | Present invention |
| 13 | Exemplified compound (III-5) | Exemplified compound (II-3) | 0.17 | 0.15 | 0.15 | 2.10 | 2.08 | 2.00 | Present invention |
| 14 | Exemplified compound (III-5) | Exemplified compound (II-15) | 0.16 | 0.15 | 0.14 | 2.10 | 2.11 | 2.01 | Present invention |
| 15 | Exemplified compound (III-5) | Exemplified compound (II-24) | 0.15 | 0.14 | 0.16 | 2.11 | 2.08 | 2.03 | Present invention |
| 16 | Exemplified compound (IV-1) | Exemplified compound (I-4) | 0.17 | 0.13 | 0.16 | 2.08 | 2.09 | 1.96 | Present invention |
| 17 | Exemplified compound (IV-1) | Exemplified compound (I-11) | 0.16 | 0.14 | 0.16 | 2.07 | 2.08 | 1.95 | Present invention |
| 18 | Exemplified compound (IV-1) | Exemplified compound (I-27) | 0.17 | 0.14 | 0.17 | 2.06 | 2.10 | 1.94 | Present invention |
| 19 | Exemplified compound (IV-1) | Exemplified compound (I-43) | 0.16 | 0.14 | 0.16 | 2.07 | 2.08 | 1.93 | Present invention |
| 20 | Exemplified Compound (IV-1) | Exemplified compound (II-3) | 0.15 | 0.15 | 0.16 | 2.09 | 2.08 | 1.94 | Present invention |
| 21 | Exemplified Compound (IV-1) | Exemplified compound (II-15) | 0.18 | 0.14 | 0.17 | 2.09 | 2.08 | 1.95 | Present invention |
| 22 | Exemplified Compound (IV-1) | Exemplified compound (II-24) | 0.17 | 0.13 | 0.18 | 2.10 | 2.06 | 1.94 | Present invention |
| 23 | Exemplified Compound (IV-1) | Exemplified compound (I-11) Exemplified compound (II-3) | 0.16 | 0.13 | 0.16 | 2.07 | 2.07 | 1.97 | Present invention |
| 24 | Exemplified compound (III-9) | Exemplified compound (I-27) | 0.15 | 0.14 | 0.18 | 2.08 | 2.07 | 1.98 | Present invention |
| 25 | Exemplified compound (III-15) | Exemplified compound (I-27) | 0.16 | 0.15 | 0.16 | 2.07 | 2.06 | 1.96 | Present invention |
| 26 | Exemplified compound (III-20) | Exemplified compound (I-27) | 0.18 | 0.15 | 0.17 | 2.06 | 2.09 | 1.99 | Present invention |
| 27 | Exemplified compound (IV-3) | Exemplified compound (II-15) | 0.16 | 0.14 | 0.18 | 2.10 | 2.08 | 1.98 | Present invention |
| 28 | Exemplified compound (IV-6) | Exemplified compound (II-15) | 0.18 | 0.14 | 0.17 | 2.12 | 2.10 | 1.97 | Present invention |
| 29 | Exemplified compound (IV-8) | Exemplified compound (II-15) | 0.17 | 0.14 | 0.18 | 0.13 | 2.11 | 2.00 | Present invention |
| 30 | Exemplified compound (III-5) Exemplified compound (IV-1) | Exemplified compound (II-15) | 0.16 | 0.16 | 0.19 | 2.11 | 2.10 | 1.99 | Present invention |
| 31 | Exemplified compound (III-5) Exemplified compound (IV-1) | Exemplified compound (I-11) | 0.15 | 0.15 | 0.18 | 2.15 | 2.10 | 2.01 | Present invention |

As is apparent from Table 1, when the light-sensitive material is processed with a color developing solution which contain compound(s) represented by the general formula(e) (I) and/or (II) of the invention in place of hydroxylamine sulfate, an image which is having a high maximum density (Dmax) and surprisingly also having a low minimum density, and thus excellent in discrimination was obtained. Further, when compound(s) represented by the general formula(e) (III) and/or (IV) is-(are) used in place of sodium sulfite besides the compound(s) of the general formula(e) (I) and/or (II), maximum density became higher and minimum density became lower and thus extremely excellent results was obtained.

EXAMPLE 2

The color photographic light-sensitive material 101 was processed according to the following process steps in place of the process steps in Example 1.

| Process steps B | Time | Temperature |
|---|---|---|
| Color development | 90 sec. | 38° C. |
| Bleach-fixing | 40 sec. | 38° C. |
| Water washing① | 30 sec. | 38° C. |
| Water washing② | 30 sec. | 38° C. |

| (Color developing solution) | Mother liquor |
|---|---|
| Disoium ethylenediamine-tetraacetate dihydrate | 2.0 g |
| Sodium sulfite | 2.0 g |
| Sodium bromide | 0.26 g |
| Hydroxylamine sulfate | 2.60 g |
| Sodium chloride | 3.20 g |
| 3-Methyl-4-amino-N-ethyl-N-hydroxyethyl-aniline | 7.0 g |
| Pottasium carbonate | 30.0 g |
| Fluorescent whitener (stilbene series) | 1.0 g |
| Demineralized water | to 1,000 ml |
| pH | 10.60 |

Bleach-fixing solution

Composition of the solution is the same in Example 1, but demineralized water was used for preparations the solution.

Liquid for water washing

Demineralized water was used. The demineralized water means herein water obtained by removing all cations other than hydrogen ion all anions other than hydroxyl ion from city water to concentration of 1.0 ppm or less thereof.

Exposure to light, other process steps than the process steps B and determination of Dmax and Dmin were conducted in the same manner as in Example 1. The resulting results are shown in Table 2, and were similar to those in Example 1.

TABLE 2

| | Preservative for the color developing solution | | Minimum density (Dmin) | | | Maximum density (Dmax) | | | |
|---|---|---|---|---|---|---|---|---|---|
| No. | Alternative to sodium sulfite | Alternative of hydroxylamine sulfate | Yellow | Magenta | Cyan | Yellow | Magenta | Cyan | |
| 1 | Sodium sulfite | Hydroxylamine sulfate | 0.48 | 0.27 | 0.49 | 1.74 | 1.83 | 1.70 | Comparative example |
| 2 | " | Exemplified compound (I-4) | 0.32 | 0.22 | 0.34 | 1.92 | 1.96 | 1.83 | Present invention |
| 3 | " | Exemplified compound (I-11) | 0.35 | 0.23 | 0.36 | 1.94 | 1.95 | 1.84 | Present invention |
| 4 | " | Exemplified compound (I-27) | 0.33 | 0.21 | 0.35 | 1.92 | 1.94 | 1.83 | Present invention |
| 5 | " | Exemplified compound (I-43) | 0.32 | 0.22 | 0.32 | 1.93 | 1.95 | 1.82 | Present invention |
| 6 | " | Exemplified compound (II-3) | 0.32 | 0.23 | 0.33 | 1.92 | 1.95 | 1.83 | Present invention |
| 7 | " | Exemplified compound (II-15) | 0.31 | 0.22 | 0.35 | 1.93 | 1.96 | 1.84 | Present invention |
| 8 | " | Exemplified compound (II-24) | 0.33 | 0.21 | 0.34 | 1.94 | 1.94 | 1.82 | Present invention |
| 9 | Exemplified compound (III-5) | Exemplified compound (I-4) | 0.20 | 0.19 | 0.24 | 2.19 | 2.12 | 2.01 | Present invention |
| 10 | Exemplified compound (III-5) | Exemplified compound (I-11) | 0.21 | 0.21 | 0.25 | 2.17 | 2.10 | 2.03 | Present invention |
| 11 | Exemplified compound (III-5) | Exemplified compound (I-27) | 0.23 | 0.20 | 0.24 | 2.16 | 2.11 | 2.02 | Present invention |
| 12 | Exemplified compound (III-5) | Exemplified compound (I-43) | 0.21 | 0.21 | 0.23 | 2.17 | 2.10 | 2.03 | Present invention |
| 13 | Exemplified compound (III-5) | Exemplified compound (II-3) | 0.22 | 0.24 | 0.24 | 2.18 | 2.12 | 2.02 | Present invention |
| 14 | Exemplified compound (III-5) | Exemplified compound (II-15) | 0.22 | 0.23 | 0.25 | 2.19 | 2.12 | 2.01 | Present invention |
| 15 | Exemplified compound (III-5) | Exemplified compound (II-24) | 0.21 | 0.21 | 0.25 | 2.16 | 2.10 | 2.02 | Present invention |
| 16 | Exemplified compound (IV-1) | Exemplified compound (I-4) | 0.22 | 0.19 | 0.26 | 2.15 | 2.10 | 2.00 | Present invention |
| 17 | Exemplified compound (IV-1) | Exemplified compound (I-11) | 0.24 | 0.22 | 0.27 | 2.16 | 2.11 | 2.00 | Present invention |
| 18 | Exemplified compound (IV-1) | Exemplified compound (I-27) | 0.23 | 0.21 | 0.26 | 2.14 | 2.10 | 2.01 | Present invention |
| 19 | Exemplified compound (IV-1) | Exemplified compound (I-43) | 0.22 | 0.22 | 0.25 | 2.16 | 2.12 | 2.02 | Present invention |
| 20 | Exemplified compound (IV-1) | Exemplified compound (II-3) | 0.23 | 0.23 | 0.26 | 2.15 | 2.10 | 1.99 | Present invention |
| 21 | Exemplified compound (IV-1) | Exemplified compound (II-15) | 0.23 | 0.22 | 0.25 | 2.15 | 2.09 | 2.01 | Present invention |
| 22 | Exemplified compound (IV-1) | Exemplified compound (II-24) | 0.24 | 0.24 | 0.24 | 2.14 | 2.11 | 1.98 | Present invention |
| 23 | Exemplified compound (IV-1) | Exemplified compound (I-11) Exemplified compound (II-3) | 0.22 | 0.23 | 0.26 | 2.16 | 2.09 | 1.98 | Present invention |
| 24 | Exemplified compound (III-9) | Exemplified compound (I-27) | 0.22 | 0.24 | 0.23 | 2.12 | 2.06 | 1.99 | Present invention |
| 25 | Exemplified compound (III-15) | Exemplified compound (I-27) | 0.21 | 0.22 | 0.24 | 2.11 | 2.07 | 2.01 | Present invention |
| 26 | Exemplified compound (III-20) | Exemplified compound (I-27) | 0.21 | 0.23 | 0.24 | 2.12 | 2.08 | 2.01 | Present invention |
| 27 | Exemplified compound (IV-3) | Exemplified compound (II-15) | 0.23 | 0.22 | 0.24 | 2.16 | 2.13 | 2.06 | Present invention |
| 28 | Exemplified compound (IV-6) | Exemplified compound (II-15) | 0.23 | 0.21 | 0.23 | 2.18 | 2.12 | 2.05 | Present invention |

TABLE 2-continued

| No. | Preservative for the color developing solution: Alternative to sodium sulfite | Alternative of hydroxylamine sulfate | Minimum density (Dmin): Yellow | Magenta | Cyan | Maximum density (Dmax): Yellow | Magenta | Cyan | |
|---|---|---|---|---|---|---|---|---|---|
| 29 | Exemplified compound (IV-8) | Exemplified compound (II-15) | 0.21 | 0.23 | 0.24 | 0.18 | 2.14 | 2.05 | Present invention |
| 30 | Exemplified compound (III-5) Exemplified compound (IV-1) | Exemplified compound (II-15) | 0.22 | 2.21 | 0.22 | 2.17 | 2.13 | 2.05 | Present invention |
| 31 | Exemplified compound (III-5) Exemplified compound (IV-1) | Exemplified compound (I-11) | 0.21 | 0.22 | 0.24 | 2.19 | 2.15 | 2.06 | Present invention |

EXAMPLE 3

Color photographic light-sensitive material 301 was prepared in the same manner as in Example 1 except that ExZS-1 of 10 times the molar amount of ExZS-1 was used as a necleation accelerator in place of ExZS-1.

ExZS-2

1-Formyl-2-{4-[3-(5-mercaptotetrazol-1-yl) benzamido]phenyl}hydrazine

The light-sensitive material 301 was exposed to light in the same manner as in Example 1 and processed according to the following steps.

| Process steps C | Time | Temperature |
|---|---|---|
| Color development | 70 sec. | 40° C. |
| Bleach-fixing | 40 sec. | 38° C. |
| Water washing① | 30 sec. | 38° C. |
| Water washing② | 30 sec. | 38° C. |

The used processing solutions are shown below.

| (Color developing solution) | Mother liquor |
|---|---|
| Disodium ethylenediamine tetraacetate dihydrate | 2.0 g |
| Sodium sulfite | 2.0 g |
| Sodium bromide | 0.26 g |
| Hydroxylamine sulfate | 2.60 g |
| Sodium chloride | 3.20 g |
| 3-Methyl-4-amino-N-ethyl-N-(β-methanesulfonamidoethyl)-aniline | 8.0 g |
| Pottasium tertiary phosphate | 25.0 g |
| Fluorescent whitener (stilbene series) | 1.0 g |
| Demineralized water | to 1,000 ml |
| pH | 11.20 |

(Bleach-fixing solution)

The same in Example 2

(Water for water washing)

The same in Example 2

The results obtained by the same processing as in Example 1 are shown in Table 3, and was similar to those in Table 1.

TABLE 3

| No. | Preservative for the color developing solution: Alternative to sodium sulfite | Alternative of hydroxylamine sulfate | Minimum density (Dmin): Yellow | Magenta | Cyan | Maximum density (Dmax): Yellow | Magenta | Cyan | |
|---|---|---|---|---|---|---|---|---|---|
| 1 | Sodium sulfite | Hydroxylamine sulfate | 0.38 | 0.25 | 0.40 | 1.78 | 1.85 | 1.72 | Comparative example |
| 2 | " | Exemplified compound (I-4) | 0.27 | 0.21 | 0.29 | 1.90 | 1.96 | 1.85 | Present invention |
| 3 | " | Exemplified compound (I-11) | 0.28 | 0.20 | 0.28 | 1.89 | 1.94 | 1.85 | Present invention |
| 4 | " | Exemplified compound (I-27) | 0.27 | 0.21 | 0.30 | 1.92 | 1.95 | 1.85 | Present invention |
| 5 | " | Exemplified compound (I-43) | 0.28 | 0.20 | 0.31 | 1.91 | 1.95 | 1.84 | Present invention |
| 6 | " | Exemplified compound (II-3) | 0.27 | 0.19 | 0.30 | 1.90 | 1.94 | 1.87 | Present invention |
| 7 | " | Exemplified compound (II-15) | 0.28 | 0.21 | 0.28 | 1.91 | 1.96 | 1.84 | Present invention |
| 8 | " | Exemplified compound (II-24) | 0.27 | 0.20 | 0.29 | 1.92 | 1.94 | 1.88 | Present invention |
| 9 | Exemplified compound (III-5) | Exemplified compound (I-4) | 0.21 | 0.17 | 0.20 | 2.10 | 2.12 | 2.04 | Present invention |
| 10 | Exemplified compound (III-5) | Exemplified compound (I-11) | 0.21 | 0.17 | 0.21 | 2.11 | 2.12 | 2.03 | Present invention |
| 11 | Exemplified compound (III-5) | Exemplified compound (I-27) | 0.20 | 0.17 | 0.20 | 2.10 | 2.10 | 2.03 | Present invention |
| 12 | Exemplified compound (III-5) | Exemplified compound (I-43) | 0.20 | 0.17 | 0.19 | 2.11 | 2.11 | 2.04 | Present invention |
| 13 | Exemplified compound (III-5) | Exemplified compound (II-3) | 0.21 | 0.18 | 0.20 | 2.12 | 2.10 | 2.04 | Present invention |
| 14 | Exemplified compound (III-5) | Exemplified compound (II-15) | 0.21 | 0.17 | 0.19 | 2.10 | 2.12 | 2.03 | Present invention |
| 15 | Exemplified compound (III-5) | Exemplified compound (II-24) | 0.20 | 0.18 | 0.20 | 2.10 | 2.12 | 2.03 | Present invention |

TABLE 3-continued

| No. | Preservative for the color developing solution: Alternative to sodium sulfite | Alternative of hydroxylamine sulfate | Minimum density (Dmin) Yellow | Magenta | Cyan | Maximum density (Dmax) Yellow | Magenta | Cyan | |
|---|---|---|---|---|---|---|---|---|---|
| 16 | Exemplified compound (IV-1) | Exemplified compound (I-4) | 0.18 | 0.19 | 0.19 | 2.13 | 2.12 | 2.05 | Present invention |
| 17 | Exemplified compound (IV-1) | Exemplified compound (I-11) | 0.17 | 0.18 | 0.21 | 2.14 | 2.12 | 2.04 | Present invention |
| 18 | Exemplified compound (IV-1) | Exemplified compound (I-27) | 0.18 | 0.16 | 0.20 | 2.13 | 2.10 | 2.03 | Present invention |
| 19 | Exemplified compound (IV-1) | Exemplified compound (I-43) | 0.17 | 0.16 | 0.21 | 2.15 | 2.11 | 2.03 | Present invention |
| 20 | Exemplified compound (IV-1) | Exemplified compound (I-3) | 0.17 | 0.16 | 0.21 | 2.14 | 2.10 | 2.04 | Present invention |
| 21 | Exemplified compound (IV-1) | Exemplified compound (II-15) | 0.19 | 0.18 | 0.20 | 2.12 | 2.10 | 2.03 | Present invention |
| 22 | Exemplified compound (IV-1) | Exemplified compound (II-24) | 0.19 | 0.17 | 0.20 | 2.14 | 2.09 | 2.02 | Present invention |
| 23 | Exemplified compound (IV-1) | Exemplified compound (I-11) Exemplifed compound (II-3) | 0.17 | 0.18 | 0.20 | 2.13 | 2.10 | 2.03 | Present invention |
| 24 | Exemplified compound (III-9) | Exemplified compound (I-27) | 0.18 | 0.19 | 0.21 | 2.14 | 2.11 | 2.02 | Present invention |
| 25 | Exemplified compound (III-15) | Exemplified compound (I-27) | 0.20 | 0.19 | 0.21 | 2.09 | 2.11 | 2.03 | Present invention |
| 26 | Exemplified compound (III-20) | Exemplified compound (I-27) | 0.20 | 0.18 | 0.19 | 2.12 | 2.10 | 2.03 | Present invention |
| 27 | Exemplified compound (IV-3) | Exemplified compound (II-15) | 0.21 | 0.18 | 0.20 | 2.13 | 2.12 | 2.02 | Present invention |
| 28 | Exemplified compound (IV-6) | Exemplified compound (II-15) | 0.21 | 0.18 | 0.21 | 2.13 | 2.10 | 2.02 | Present invention |
| 29 | Exemplified compound (IV-8) | Exemplified compound (II-15) | 0.20 | 0.17 | 0.19 | 2.14 | 2.09 | 2.03 | Present invention |
| 30 | Exemplified compound (III-5) Exemplified compound (IV-1) | Exemplified compound (II-15) | 0.19 | 0.20 | 0.21 | 2.13 | 2.11 | 1.02 | Present invention |
| 31 | Exemplified compound (III-5) Exemplified compound (IV-1) | Exemplified compound (I-11) | 0.19 | 0.20 | 0.21 | 2.13 | 2.12 | 2.01 | Present invention |

EXAMPLE 4

Color photographic light-sensitive material 401 gas prepared in the same procedures as those for preparation of the color photographic light-sensitive material 101 in Example 1 except that the nucleating agent and nucleation accelerator were not used. The color photographs light-sensitive material 401 was processed according to the following steps.

| Process steps D | Time | Temperature |
|---|---|---|
| Color development* | 120 sec. | 38° C. |
| Bleach-fixing | 40 sec. | 38° C. |
| Stabilization① | 30 sec. | 35° C. |
| Stabilization② | 30 sec. | 35° C. |
| Drying | 40 sec. | 70° C. |

*Color developing process was conducted while light fogging was made at 0.6 CMS at 4,200° K. for 15 seconds from 10 seconds after starting of the color developing. Compositions of the processing solutions were as follows.

| (Color developing solution) | Mother liquor |
|---|---|
| Disodium ethylenediaminetetraacetate dihydrate | 2.0 g |
| Sodium sulfite | 2.0 g |
| Sodium bromide | 0.26 g |
| Hydroxylamine sulfate | 2.60 g |
| Sodium chloride | 3.20 g |
| 3-Methyl-4-amino-N-ethyl-N-hydroxyethyl- | 5.0 g |

-continued

| (Color developing solution) | Mother liquor |
|---|---|
| aniline | |
| 3-Methyl-4-amino-N-ethyl-N-(β-methanesulfonamidoethyl-aniline | 3.0 g |
| Pottasium carbonate | 25 g |
| Fluorescent whitener (stilbene series) | 1.0 g |
| Demineralized water | to 1,000 ml |
| (Bleach-fixing solution) | |
| Ammonium thiosulfate | 110 g |
| Sodium bisultite | 10 g |
| Ammonium (diethylenetriaminepentaacetato) iron (III) | 80 g |
| Diethylenetriaminepentaacetic acid | 5 g |
| 2-Mercapto-1,3,4-triazole | 0.5 g |
| Demineralized water | to 1,000 ml |
| pH | 6.5 |
| (Stabilizing solutions①and②) | |
| 1-Hydroxyethylidene-1,1'-diphosphonic acid | 1.8 g |
| o-Phenylphenol | 0.20 g |
| Pottasium chloride | 4.5 g |
| Fluorescent whitener (stilbene series) | 3.0 g |
| Formalin (37%) | 0.10 ml |
| Demineralized water | to 1,000 ml |
| pH | 7.20 |

The above process was repeated except using compounds shown in Table 4 in place of sodium sulfite and sodium sulfate in the color developing solution in the same molar amount therewith. The resulting results are shown in Table 4.

TABLE 4

| No. | Preservative for the color developing solution: Alternative to sodium sulfite | Preservative for the color developing solution: Alternative of hydroxylamine sulfate | Minimum density (Dmin): Yellow | Minimum density (Dmin): Magenta | Minimum density (Dmin): Cyan | Maximum density (Dmax): Yellow | Maximum density (Dmax): Magenta | Maximum density (Dmax): Cyan | |
|---|---|---|---|---|---|---|---|---|---|
| 1 | Sodium sulfite | Hydroxylamine sulfate | 0.52 | 0.30 | 0.53 | 1.68 | 1.65 | 1.62 | Comparative example |
| 2 | " | Exemplified compound (I-4) | 0.37 | 0.25 | 0.34 | 1.86 | 1.80 | 1.72 | Present invention |
| 3 | " | Exemplified compound (II-11) | 0.36 | 0.23 | 0.31 | 1.86 | 1.82 | 1.72 | Present invention |
| 4 | " | Exemplified compound (I-27) | 0.40 | 0.25 | 0.34 | 1.86 | 1.79 | 1.72 | Present invention |
| 5 | " | Exemplified compound (I-43) | 0.39 | 0.25 | 0.33 | 1.85 | 1.80 | 1.73 | Present invention |
| 6 | " | Exemplified compound (II-3) | 0.40 | 0.24 | 0.33 | 1.84 | 1.78 | 1.74 | Present invention |
| 7 | " | Exemplified compound (II-15) | 0.39 | 0.23 | 0.35 | 1.83 | 1.78 | 1.70 | Present invention |
| 8 | " | Exemplified compound (II-24) | 0.38 | 0.24 | 0.32 | 1.85 | 1.80 | 1.71 | Present invention |
| 9 | Exemplified compound (III-5) | Exemplified compound (I-4) | 0.26 | 0.22 | 0.24 | 1.99 | 1.87 | 1.82 | Present invention |
| 10 | Exemplified compound (III-5) | Exemplified compound (II-11) | 0.25 | 0.21 | 0.23 | 1.93 | 1.85 | 1.86 | Present invention |
| 11 | Exemplified compound (III-5) | Exemplified compound (I-27) | 0.26 | 0.21 | 0.23 | 1.96 | 1.88 | 1.82 | Present invention |
| 12 | Exemplified compound (III-5) | Exemplified compound (I-43) | 0.28 | 0.22 | 0.22 | 1.94 | 1.85 | 1.80 | Present invention |
| 13 | Exemplified compound (III-5) | Exemplified compound (II-3) | 0.26 | 0.23 | 0.22 | 1.97 | 1.83 | 1.81 | Present invention |
| 14 | Exemplified compound (III-5) | Exemplified compound (II-15) | 0.25 | 0.22 | 0.24 | 1.98 | 1.86 | 1.85 | Present invention |
| 15 | Exemplified compound (III-5) | Exemplified compound (II-24) | 0.27 | 0.22 | 0.23 | 1.96 | 1.88 | 1.84 | Present invention |
| 16 | Exemplified compound (IV-1) | Exemplified compound (I-4) | 0.24 | 0.20 | 0.26 | 2.01 | 1.92 | 1.91 | Present invention |
| 17 | Exemplified compound (IV-1) | Exemplified compound (II-11) | 0.21 | 0.20 | 0.23 | 2.02 | 1.96 | 1.93 | Present invention |
| 18 | Exemplified compound (IV-1) | Exemplified compound (I-27) | 0.23 | 0.20 | 0.24 | 2.03 | 1.96 | 1.91 | Present invention |
| 19 | Exemplified compound (IV-1) | Exemplified compound (I-43) | 0.24 | 0.21 | 0.23 | 2.02 | 1.95 | 1.90 | Present invention |
| 20 | Exemplified compound (IV-1) | Exemplified compound (II-3) | 0.23 | 0.21 | 0.25 | 2.02 | 1.95 | 1.91 | Present invention |
| 21 | Exemplified compound (IV-1) | Exemplified compound (II-15) | 0.22 | 0.20 | 0.23 | 2.01 | 1.96 | 1.90 | Present invention |
| 22 | Exemplified compound (IV-1) | Exemplified compound (II-24) | 0.22 | 0.20 | 0.24 | 2.03 | 1.98 | 1.92 | Present invention |
| 23 | Exemplified compound (IV-1) | Exemplified compound (II-3) | 0.20 | 0.19 | 0.23 | 2.02 | 1.99 | 1.94 | Present invention |
| 24 | Exemplified compound (III-9) | Exemplified compound (I-27) | 0.21 | 0.18 | 0.25 | 2.04 | 2.03 | 1.98 | Present invention |
| 25 | Exemplified compound (III-15) | Exemplified compound (I-27) | 0.22 | 0.19 | 0.24 | 2.06 | 2.02 | 1.97 | Present invention |
| 26 | Exemplified compound (III-20) | Exemplified compound (I-27) | 0.20 | 0.19 | 0.24 | 2.07 | 2.04 | 1.96 | Present invention |
| 27 | Exemplified compound (IV-3) | Exemplified compound (II-15) | 0.23 | 0.19 | 0.24 | 2.10 | 2.07 | 1.99 | Present invention |
| 28 | Exemplified compound (IV-6) | Exemplified compound (II-15) | 0.24 | 0.20 | 0.26 | 2.10 | 2.08 | 2.01 | Present invention |
| 29 | Exemplified compound (IV-8) | Exemplified compound (II-15) | 0.23 | 0.21 | 0.22 | 2.08 | 2.08 | 2.00 | Present invention |
| 30 | Exemplified compound (III-5) Exemplified compound (IV-1) | Exemplified compound (II-15) | 0.21 | 0.21 | 0.23 | 2.09 | 2.07 | 2.01 | Present invention |
| 31 | Exemplified compound (III-5) Exemplified compound (IV-1) | Exemplified compound (II-11) | 0.20 | 0.19 | 0.24 | 2.12 | 2.10 | 2.01 | Present invention |

As is seen from Table 4, the resulting results revealed a tendency similar to that in Example 1.

EXAMPLE 5

In this example, 1 l portions of the color developing solutions prepared in Examples 1 and 2 were placed in beakers, respectively, and allowed to stand at 40° C. for one week.

Then, the color photographic light-sensitive materials 101 processed with the color developing solutions before and after the time lapse, respectively, and then difference in photographic performances was examined. That is, the color photographic light-sensitive materials 101 were processed with the color developing solutions of Example 1 before and after the time lapse according to the process steps in Example 1, respectively, and the light-sensitive materials 101 were also processed with the color developing solutions of Example 2 therefore and after the time lapse according to the process steps in Example 2, respectively. The light-sensitive material in each process was exposed to light of 100 CMS using an optical wedge. Exposure amounts giving a yellow density of 1.0, a magenta density of 1.0 and a cyan density of 1.0 were respectively determined in processing with the color developing solutions before the time lapse. Then, respective density changes ($\Delta D_B$, 1.0, $\Delta D_G$, 1.0 and $\Delta D_R$, 1.0) in the above exposure amounts in processing with the color developing after the time lapse were determined. The results are shown in Table 5.

TABLE 5

| No. | Color developing solution | Change of photographic performance with the time lapse | | | |
|---|---|---|---|---|---|
| | | $\Delta D_B$, 1.0 | $\Delta D_G$, 1.0 | $\Delta D_R$, 1.0 | |
| 1 | Example 1 No. 1 | −0.23 | +0.18 | +0.15 | Comparative example |
| 2 | 2 | −0.17 | +0.14 | +0.10 | Present invention |
| 3 | 3 | −0.15 | +0.12 | +0.10 | Present invention |
| 4 | 4 | −0.16 | +0.14 | +0.12 | Present invention |
| 5 | 5 | −0.14 | +0.12 | +0.13 | Present invention |
| 6 | 6 | −0.15 | +0.13 | +0.12 | Present invention |
| 7 | 7 | −0.16 | +0.13 | +0.11 | Present invention |
| 8 | 8 | −0.18 | +0.14 | +0.10 | Present invention |
| 9 | 9 | −0.12 | +0.09 | +0.07 | Present invention |
| 10 | 10 | −0.11 | +0.09 | +0.06 | Present invention |
| 11 | 11 | −0.12 | +0.10 | +0.06 | Present invention |
| 12 | 12 | −0.12 | +0.09 | +0.07 | Present invention |
| 13 | 13 | −0.10 | +0.08 | +0.08 | Present invention |
| 14 | 14 | −0.12 | +0.09 | +0.07 | Present invention |
| 15 | 15 | −0.13 | +0.10 | +0.08 | Present invention |
| 16 | 16 | −0.11 | +0.10 | +0.06 | Present invention |
| 17 | 17 | −0.10 | +0.09 | +0.06 | Present invention |
| 18 | 18 | −0.13 | +0.11 | +0.07 | Present invention |
| 19 | 19 | −0.12 | +0.10 | +0.08 | Present invention |
| 20 | 20 | −0.13 | +0.09 | +0.08 | Present invention |
| 21 | 21 | −0.11 | +0.09 | +0.07 | Present invention |
| 22 | 22 | −0.12 | +0.10 | +0.06 | Present invention |
| 23 | 23 | −0.12 | +0.09 | +0.07 | Present invention |
| 24 | 24 | −0.13 | +0.10 | +0.08 | Present invention |
| 25 | 25 | −0.12 | +0.11 | +0.08 | Present invention |
| 26 | 26 | −0.13 | +0.09 | +0.07 | Present invention |
| 27 | 27 | −0.12 | +0.09 | +0.08 | Present invention |
| 28 | 28 | −0.12 | +0.10 | +0.08 | Present invention |
| 29 | 29 | −0.13 | +0.09 | +0.07 | Present invention |
| 30 | 30 | −0.12 | +0.10 | +0.08 | Present invention |
| 31 | Example 2 No. 1 | −0.30 | +0.25 | +0.15 | Comparative example |
| 32 | 2 | −0.14 | +0.12 | +0.11 | Present invention |
| 33 | 3 | −0.13 | +0.11 | +0.12 | Present invention |
| 34 | 4 | −0.12 | +0.12 | +0.11 | Present invention |
| 35 | 5 | −0.12 | +0.13 | +0.10 | Present invention |
| 36 | 6 | −0.11 | +0.12 | +0.10 | Present invention |
| 37 | 7 | −0.14 | +0.13 | +0.11 | Present invention |
| 38 | 8 | −0.12 | +0.13 | +0.11 | Present invention |
| 39 | 9 | −0.08 | +0.09 | +0.04 | Present invention |
| 40 | 10 | −0.08 | +0.08 | +0.03 | Present invention |
| 41 | 11 | −0.07 | +0.07 | +0.03 | Present invention |
| 42 | 12 | −0.09 | +0.09 | +0.04 | Present invention |
| 43 | 13 | −0.06 | +0.06 | +0.03 | Present invention |
| 44 | 14 | −0.07 | +0.08 | +0.04 | Present invention |
| 45 | 15 | −0.08 | +0.09 | +0.05 | Present invention |
| 46 | 16 | −0.06 | +0.08 | +0.02 | Present invention |
| 47 | 17 | −0.08 | +0.09 | +0.03 | Present invention |
| 48 | 18 | −0.08 | +0.07 | +0.04 | Present invention |
| 49 | Example 2 No. 19 | −0.07 | +0.07 | +0.02 | Present invention |
| 50 | 20 | −0.06 | +0.06 | +0.03 | Present invention |
| 51 | 21 | −0.08 | +0.06 | +0.04 | Present invention |
| 52 | 22 | −0.07 | +0.07 | +0.03 | Present invention |
| 53 | 23 | −0.07 | +0.05 | +0.02 | Present invention |
| 54 | 24 | −0.07 | +0.05 | +0.02 | Present invention |
| 55 | 25 | −0.05 | +0.06 | +0.05 | Present invention |
| 56 | 26 | −0.06 | +0.08 | +0.04 | Present invention |
| 57 | 27 | −0.06 | +0.05 | +0.03 | Present invention |
| 58 | 28 | −0.08 | +0.07 | +0.04 | Present invention |
| 59 | 29 | −0.07 | +0.07 | +0.03 | Present invention |
| 60 | 30 | −0.08 | +0.06 | +0.04 | Present invention |

As is apparent from Table 5, with respect to all of the color developing solutions of Examples 1 and 2, the light-sensitive materials processed using the color developing solutions of the invention have a smaller photographic performance change between before and after the time lapse (that is, values of $\Delta D_B$, 1.0, $\Delta D_G$1.0 and $\Delta D_R$, 1.0 are nearer to 0) than the light-sensitive materials processed using the color developing solutions of the comparative examples, and therefore, the color developing solutions of the invention are superior to those of the comparative examples in stability with time lapse.

Further, the following two points were recognized in the color developing solution of the invention that the color developing solutions containing no sodium sulfite (Nos. 9 to 30, and 39 to 60) are superior to the color developing solutions containing sodium sulfite (Nos. 2 to 8 and 32 to 38) in stability with time lapse, and that the color developing solutions containing 3-methyl-4-amino-N-ethyl-N-hydroxyethylaniline but no benzyl alcohol are superior to those containing 3-methyl-4-amino-N-ethyl-N-(β-methanesulfonamidoetyl)aniline and benzyl alcohol in stability with time lapse.

EXAMPLE 6

Color developing solutions where disodium ethylenediaminetetraacetate dihydrate, sodium sulfite and hydroxylamine sulfate in the color developing solution of Example 2 were replaced by compounds shown in Table 6 were prepared. Then, 1 l portions of these color developing solutions were placed in 1l-beakers, and allowed to stand at room temperature for 3 weeks. Then, observation of these color developing solutions and determination of absorbance thereof were conducted, and the results are shown in Table 6. Color developing solutions Nos. 1 to 10 of the present test were prepared using city water and Nos. 11 to 20 were prepared using demineralized water.

TABLE 6

| No. | | Water used for preparation of to sodium the solution | Preservative for color developing solution: Alternative xylamine sulfite | Preservative for color developing solution: Alternative to hydroxylamine sulfate | Chelating compound | State of the solution after the time lapse at room temperature: Coloring degree (absorbance 500 nm) | Formation to tar |
|---|---|---|---|---|---|---|---|
| 1 | Comparative example | City water | — | — | Ethylenediaminetetraacetic acid | Completely blackened | xx |
| 2 | Comparative example | " | Sodium sulfite | Hydroxylamine sulfite | Ethylenediaminetetraacetic acid | 0.42 | Δ |
| 3 | Present Invention | " | Exemplified compound (II-11) | Hydroxylamine sulfite | Ethylenediaminetetraacetic acid | 0.35 | Δ |
| 4 | Present Invention | " | Exemplified compound (II-15) | Hydroxylamine sulfite | Ethylenediaminetetraacetic acid | 0.37 | Δ |
| 5 | Present Invention | " | Exemplified compound (II-11) | Exemplified compound (III-5) | Ethylenediaminetetraacetic acid | 0.31 | Δ |
| 6 | Present Invention | " | Exemplified compound (I-27) | Exemplified compound (III-5) | Ethylenediaminetetraacetic acid | 0.29 | Δ |
| 7 | Present Invention | " | Exemplified compound (I-43) | Exemplified compound (III-5) | Ethylenediaminetetraacetic acid | 0.28 | Δ |
| 8 | Present Invention | " | Exemplified compound (II-3) | Exemplified compound (IV-1) | Ethylenediaminetetraacetic acid | 0.25 | Δ |
| 9 | Present Invention | " | Exemplified compound (II-15) | Exemplified compound (IV-1) | Ethylenediaminetetraacetic acid | 0.28 | Δ |
| 10 | Present Invention | " | Exemplified compound (II-24) | Exemplified compound (IV-1) | Ethylenediaminetetraacetic acid | 0.27 | Δ |
| 11 | Present Invention | Demineralized water | Exemplified compound (II-24) | Exemplified compound (III-5) | Ethylenediaminetetraacetic acid | 0.20 | Δ–o |
| 12* | Present Invention | Demineralized water | Exemplified compound (I-43) | Exemplified compound (IV-1) | Ethylenediaminetetraacetic acid | 0.21 | x |
| 13 | Present Invention | Demineralized water | Exemplified compound (I-43) | Exemplified compound (IV-1) | Chelating compound A | 0.13 | o |
| 14 | Present Invention | Demineralized water | Exemplified compound (I-43) | Exemplified compound (IV-1) | Chelating compound B | 0.14 | o |
| 15 | Present Invention | Demineralized water | Exemplified compound (I-43) | Exemplified compound (IV-1) | Chelating compound C | 0.12 | o |
| 16 | Present Invention | Demineralized water | Exemplified compound (I-43) | Exemplified compound (IV-1) | Chelating compound D | 0.11 | o |
| 17 | Present Invention | Demineralized water | Exemplified compound (I-43) | Exemplified compound (IV-1) | Chelating compound E | 0.08 | o |
| 18 | Present Invention | Demineralized water | Exemplified compound (I-43) | Exemplified compound (IV-1) | Chelating compound F | 0.10 | o |
| 15 | Present Invention | Demineralized water | Exemplified compound | Exemplified compound | Chelating compound G | 0.18 | o |

TABLE 6-continued

| No. | | Water used for preparation of to sodium the solution | Preservative for color developing solution: Alternative xylamine sulfite | Preservative for color developing solution: Alternative to hydro- sulfate | bance Chelating compound | State of the solution after the time lapse at room temperature: Coloring degree (absor- 500 nm) | Formation to tar |
|---|---|---|---|---|---|---|---|
| 20 | Present Invention | Demineralized water | (I-43) Exemplified compound (I-43) | (IV-1) Exemplified compound (IV-1) | Chelating compound H | 0.15 | o |

Chelating compounds in Table 6

A Ethylenediaminetetramethylenephosphonic acid
B 1-Hydroxyethylidene-1,1-diphosphonic acid
C Cyclohexanediaminetetraacetic acid
D Diethylenetriaminepentaacetic acid
E Diaminopropanoltetraacetic acid
F Nitrilo-N,N,N-trimethylenephosphonic acid
G 1,2,4-Tricarboxy-2-butanephosphonic acid
H 5-Sulfosalicylic acid Evaluation of tar formation in Table 6 xx Completely blackened
x Formation of tar was clearly observed
Δ, Δ-o Slight tar was formed (Tar formation degree is further smaller in Δ-o than in Δ )
o Formation of tar was not observed

*In No. 12, 15 ml of benzyl alcohol and 10 ml of diethylene glycol were added par 1 l of the color developing solution As apparent from Table 6, the color developing solutions of the invention are superior to the color developing solution of comparative example (2) containing the sulfite and hydroxylamine sulfate on the point of coloring property and formation of tar. Further, the color developing solution, of the invention are much superior to those of comparative example (1) containing no preservative on the point of the above properties.

Further, an result that the color developing solutions prepared using demineralized water are superior to those prepared using city water on the point of coloring degree of the solutions was obtained. In this connection, the Fe ion concentration in the city water was $6.0\times10^{-4}$ g per 1 l of the city water, and that in the demineralized water was below $1.0\times10^{-4}$ g and could not be detected.

Further, a result was obtained that the color developing solutions of the invention containing respective chelating compounds of Nos. 13 to 20 are further superior to those containing disodium ethylenediaminetetraacetate dihydrate on the point of coloring degree.

Further, it has been found that the color developing solution containing benzyl alcohol (No.12) is only slightly colored but formation of tar occurs therein.

EXAMPLE 7

The procedure in Example 1 was repeated except that compounds shown in Table 7 were used as an alternative of sodium sulfite or an alternative of hydroxylamino sulfate, respectively, and results shown in Table 7 were obtained.

TABLE 7

| No. | Preservative for the color developing solution: Alternative to sodium sulfite | Alternative of hydroxylamine sulfate | Minimum density (Dmin): Yellow | Magenta | Cyan | Maximum density (Dmax): Yellow | Magenta | Cyan | |
|---|---|---|---|---|---|---|---|---|---|
| 1 | Sodium sulfite | Hydroxylamine sulfate | 0.35 | 0.22 | 0.41 | 1.80 | 1.85 | 1.73 | Comparative example |
| 2 | (III-5) | Hydroxylamine sulfate | 0.26 | 0.18 | 0.30 | 1.92 | 1.97 | 1.89 | Presention invention |
| 3 | (III-12) | Hydroxylamine sulfate | 0.27 | 0.16 | 0.32 | 1.94 | 1.96 | 1.90 | Present invention |
| 4 | (III-19) | Hydroxylamine sulfate | 0.26 | 0.17 | 0.29 | 1.91 | 1.98 | 1.91 | Present invention |
| 5 | (III-5) | (V-2) | 0.18 | 0.15 | 0.24 | 2.08 | 2.05 | 2.01 | Present invention |
| 6 | (III-12) | " | 0.18 | 0.16 | 0.25 | 2.09 | 2.06 | 2.03 | Present invention |
| 7 | (III-19) | " | 0.19 | 0.17 | 0.24 | 2.10 | 2.07 | 2.03 | Present invention |
| 8 | (III-5) | (V-15) | 0.17 | 0.15 | 0.20 | 2.15 | 2.10 | 2.05 | Present invention |
| 9 | (III-12) | " | 0.16 | 0.15 | 0.21 | 2.13 | 2.12 | 2.04 | Present invention |
| 10 | (III-19) | " | 0.17 | 0.14 | 0.20 | 2.12 | 2.10 | 2.05 | Present invention |
| 11 | (III-5) | (VI-5) | 0.20 | 0.17 | 0.22 | 2.11 | 2.08 | 2.04 | Present |

TABLE 7-continued

| No. | Preservative for the color developing solution: Alternative to sodium sulfite | Alternative of hydroxylamine sulfate | Minimum density (Dmin): Yellow | Magenta | Cyan | Maximum density (Dmax): Yellow | Magenta | Cyan | |
|---|---|---|---|---|---|---|---|---|---|
| | | | | | | | | | invention |
| 12 | (III-12) | " | 0.20 | 0.16 | 0.23 | 2.10 | 2.07 | 2.05 | Present invention |
| 13 | (III-19) | " | 0.18 | 0.17 | 0.22 | 2.12 | 2.09 | 2.04 | Present invention |
| 14 | (III-2) | (VI-33) | 0.17 | 0.14 | 0.20 | 2.15 | 2.11 | 2.06 | Present invention |
| 15 | (III-5) | " | 0.16 | 0.15 | 0.20 | 2.14 | 2.12 | 2.06 | Present invention |
| 16 | (III-9) | " | 0.17 | 0.14 | 0.19 | 2.15 | 2.12 | 2.05 | Present invention |
| 17 | (III-12) | " | 0.17 | 0.14 | 0.19 | 2.16 | 2.11 | 2.05 | Present invention |
| 18 | (III-16) | " | 0.16 | 0.15 | 0.20 | 2.15 | 2.12 | 2.06 | Present invention |
| 19 | (III-19) | " | 0.18 | 0.15 | 0.19 | 2.15 | 2.12 | 2.05 | Present invention |
| 20 | (III-20) | " | 0.17 | 0.15 | 0.21 | 2.16 | 2.12 | 2.06 | Present invention |

As is apparent from Table 7, when the light-sensitive material is processed with a color developing solution which containing a compound represented by the general formula (III) of the invention in place of sodium sulfite, an image which is having a high maximum density (Dmax) and surprisingly also having a low minimum density, and thus excellent in discrimination was obtained. Particularly when another hydroxyamine and/or a hydroxypolyimine were used in place of hydroxylamine sulfate together with a compound of the general formula (III), particularly excellent results was obtained.

EXAMPLE 8

The color photographic light-sensitive material 101 was processed using the process steps of Example 2 in place of those of Example 7. Then, the resulting light-sensitive material 101 was subjected to exposure to light and then process steps in the same manner as in example 1, and Dmax and Dmin were determined. The resulting results are shown in Table 8, and were similar to those of Example 7.

TABLE 8

| No. | Preservative for the color developing solution: Alternative to sodium sulfite | Alternative of hydroxylamine sulfate | Minimum density (Dmin): Yellow | Magenta | Cyan | Maximum density (Dmax): Yellow | Magenta | Cyan | |
|---|---|---|---|---|---|---|---|---|---|
| 1 | Sodium sulfite | Hydroxylamine sulfate | 0.48 | 0.27 | 0.49 | 1.74 | 1.83 | 1.70 | Comparative example |
| 2 | (III-5) | Hydroxylamine sulfate | 0.33 | 0.22 | 0.38 | 1.88 | 1.95 | 1.85 | Present invention |
| 3 | (III-12) | Hydroxylamine sulfate | 0.32 | 0.21 | 0.36 | 1.87 | 1.93 | 1.83 | Present invention |
| 4 | (III-19) | Hydroxylamine sulfate | 0.32 | 0.22 | 0.36 | 1.96 | 1.93 | 1.84 | Present invention |
| 5 | (III-5) | (V-2) | 0.20 | 0.18 | 0.25 | 2.10 | 2.08 | 1.99 | Present invention |
| 6 | (III-12) | " | 0.21 | 0.19 | 0.23 | 2.09 | 2.07 | 2.01 | Present invention |
| 7 | (III-19) | " | 0.21 | 0.18 | 0.24 | 2.09 | 2.08 | 2.00 | Present invention |
| 8 | (III-5) | (V-15) | 0.18 | 0.16 | 0.22 | 2.13 | 2.11 | 2.07 | Present invention |
| 9 | (III-12) | " | 0.18 | 0.16 | 0.21 | 2.12 | 2.12 | 2.07 | Present invention |
| 10 | (III-19) | " | 0.17 | 0.17 | 0.23 | 2.12 | 2.12 | 2.05 | Present invention |
| 11 | (III-5) | (VI-5) | 0.22 | 0.20 | 0.25 | 2.08 | 2.05 | 1.98 | Present invention |
| 12 | (III-12) | " | 0.21 | 0.20 | 0.25 | 2.08 | 2.03 | 1.97 | Present invention |
| 13 | (III-19) | " | 0.23 | 0.20 | 0.26 | 2.07 | 2.03 | 1.97 | Present invention |
| 14 | (III-2) | (VI-33) | 0.18 | 0.16 | 0.20 | 2.12 | 2.12 | 2.06 | Present invention |
| 15 | (III-5) | " | 0.19 | 0.16 | 0.21 | 2.15 | 2.12 | 2.06 | Present invention |
| 16 | (III-9) | " | 0.18 | 0.16 | 0.21 | 2.13 | 2.12 | 2.08 | Present invention |

TABLE 8-continued

| No. | Preservative for the color developing solution: Alternative to sodium sulfite | Alternative of hydroxylamine sulfate | Minimum density (Dmin): Yellow | Magenta | Cyan | Maximum density (Dmax): Yellow | Magenta | Cyan | |
|---|---|---|---|---|---|---|---|---|---|
| 17 | (III-12) | " | 0.17 | 0.17 | 0.23 | 2.12 | 2.13 | 2.08 | Present invention |
| 18 | (III-16) | " | 0.17 | 0.17 | 0.21 | 2.14 | 2.12 | 2.07 | Present invention |
| 19 | (III-19) | " | 0.18 | 0.16 | 0.23 | 2.13 | 2.14 | 2.08 | Present invention |
| 20 | (III-20) | " | 0.17 | 0.17 | 0.22 | 2.13 | 2.12 | 2.06 | Present invention |

EXAMPLE 9

The light-sensitive material 301 (please refer to Example 3) was exposed to light in the same manner as in Example 7, and subjected to color development, bleach-fixing and water washing processes in the same manner as in Example 3. The light-sensitive material was then processed in the same manner as in Example 7. The resulting results are shown in Table 9, and were similar to those obtained in (Example 7.

EXAMPLE 10

The color photographic light-sensitive material 401 was processed according to the following process steps.

| Process steps D' | Time | Temperature |
|---|---|---|
| Color development* | 120 sec. | 38° C. |
| Bleach-fixing | 40 sec. | 38° C. |
| Stabilization① | 30 sec. | 35° C. |
| Stabilization② | 30 sec. | 35° C. |

TABLE 9

| No. | Preservative for the color developing solution: Alternative to sodium sulfite | Alternative of hydroxylamine sulfate | Minimum density (Dmin): Yellow | Magenta | Cyan | Maximum density (Dmax): Yellow | Magenta | Cyan | |
|---|---|---|---|---|---|---|---|---|---|
| 1 | Sodium sulfite | Hydroxylamine sulfate | 0.38 | 0.25 | 0.40 | 1.78 | 1.85 | 1.72 | Comparative example |
| 2 | (III-5) | Hydroxylamine sulfate | 0.29 | 0.20 | 0.33 | 1.90 | 1.94 | 1.82 | Present invention |
| 3 | (III-12) | Hydroxylamine sulfate | 0.28 | 0.21 | 0.32 | 1.88 | 1.96 | 1.83 | Present invention |
| 4 | (III-19) | Hydroxylamine sulfate | 0.28 | 0.21 | 0.32 | 1.91 | 1.98 | 1.84 | Present invention |
| 5 | (III-5) | (V-2) | 0.19 | 0.18 | 0.26 | 2.05 | 2.02 | 1.96 | Present invention |
| 6 | (III-12) | " | 0.20 | 0.16 | 0.26 | 2.07 | 2.02 | 1.98 | Present invention |
| 7 | (III-19) | " | 0.20 | 0.17 | 0.27 | 2.07 | 2.03 | 1.98 | Present invention |
| 8 | (III-5) | (V-15) | 0.17 | 0.15 | 0.24 | 2.14 | 2.10 | 2.04 | Present invention |
| 9 | (III-12) | " | 0.16 | 0.15 | 0.23 | 2.13 | 2.11 | 2.03 | Present invention |
| 10 | (III-19) | " | 0.16 | 0.15 | 0.23 | 2.13 | 2.11 | 2.03 | Present invention |
| 11 | (III-5) | (VI-5) | 0.21 | 0.18 | 0.27 | 2.12 | 2.08 | 2.01 | Present invention |
| 12 | (III-12) | " | 0.21 | 0.19 | 0.27 | 2.12 | 2.08 | 2.01 | Present invention |
| 13 | (III-19) | " | 0.22 | 0.19 | 0.27 | 2.12 | 2.06 | 2.00 | Present invention |
| 14 | (III-2) | (VI-33) | 0.17 | 0.14 | 0.24 | 2.14 | 2.08 | 2.02 | Present invention |
| 15 | (III-5) | " | 0.16 | 0.14 | 0.24 | 2.15 | 2.07 | 2.03 | Present invention |
| 16 | (III-9) | " | 0.16 | 0.14 | 0.23 | 2.15 | 2.07 | 2.03 | Present invention |
| 17 | (III-12) | " | 0.16 | 0.15 | 0.24 | 2.15 | 2.07 | 2.02 | Present invention |
| 18 | (III-16) | " | 0.17 | 0.15 | 0.24 | 2.13 | 2.05 | 2.03 | Present invention |
| 19 | (III-19) | " | 0.17 | 0.14 | 0.24 | 2.14 | 2.07 | 2.07 | Present invention |
| 20 | (III-20) | " | 0.17 | 0.14 | 0.23 | 2.14 | 2.09 | 2.07 | Present invention |

-continued

| Process steps D' | Time | Temperature |
|---|---|---|
| Drying | 40 sec. | 70° C. |

*Color developing process was conducted while light fogging was made at 0.6 CMS at 4,200° K. for 15 seconds from starting of the color developing. Compositions of the processing solutions were the same as in Example 4.

Then, the above process was repeated using compounds iu Table 10 in place of sodium sulfide and sodium sulfate in the color developing solution in the same molar amount therewith. The resulting results which revealed a tendency similar to those in Example 7 are shown in Table 10.

TABLE 10

| No. | Preservative for the color developing solution: Alternative to sodium sulfite | Alternative of hydroxylamine sulfate | Minimum density (Dmin) Yellow | Magenta | Cyan | Maximum density (Dmax) Yellow | Magenta | Cyan | |
|---|---|---|---|---|---|---|---|---|---|
| 1 | Sodium sulfite | Hydroxylamine sulfate | 0.52 | 0.30 | 0.53 | 1.68 | 1.65 | 1.62 | Comparative example |
| 2 | (III-5) | Hydroxylamine sulfate | 0.36 | 0.21 | 0.40 | 1.76 | 1.72 | 1.80 | Present invention |
| 3 | (III-12) | Hydroxylamine sulfate | 0.37 | 0.20 | 0.41 | 1.79 | 1.73 | 1.83 | Present invention |
| 4 | (III-19) | Hydroxylamine sulfate | 0.37 | 0.19 | 0.41 | 1.80 | 1.73 | 1.82 | Present invention |
| 5 | (III-5) | (V-2) | 0.23 | 0.18 | 0.30 | 1.95 | 1.90 | 1.91 | Present invention |
| 6 | (III-12) | " | 0.23 | 0.18 | 0.31 | 1.94 | 1.91 | 1.94 | Present invention |
| 7 | (III-19) | " | 0.24 | 0.18 | 0.32 | 1.95 | 1.92 | 1.95 | Present invention |
| 8 | (III-5) | (V-15) | 0.18 | 0.17 | 0.26 | 2.15 | 2.11 | 2.06 | Present invention |
| 9 | (III-12) | " | 0.19 | 0.18 | 0.25 | 2.16 | 2.10 | 2.07 | Present invention |
| 10 | (III-19) | " | 0.18 | 0.17 | 0.25 | 2.16 | 2.10 | 2.07 | Present invention |
| 11 | (III-5) | (VI-5) | 0.20 | 0.17 | 0.28 | 2.06 | 1.93 | 2.05 | Present invention |
| 12 | (III-12) | " | 0.21 | 0.18 | 0.29 | 2.07 | 1.92 | 2.05 | Present invention |
| 13 | (III-19) | " | 0.21 | 0.17 | 0.28 | 2.06 | 1.92 | 2.04 | Present invention |
| 14 | (III-2) | (VI-33) | 0.19 | 0.17 | 0.25 | 2.12 | 2.07 | 2.05 | Present invention |
| 15 | (III-5) | " | 0.19 | 0.16 | 0.23 | 2.14 | 2.08 | 2.04 | Present invention |
| 16 | (III-9) | " | 0.19 | 0.17 | 0.23 | 2.14 | 2.07 | 2.06 | Present invention |
| 17 | (III-12) | " | 0.18 | 0.16 | 0.23 | 2.12 | 2.06 | 2.06 | Present invention |
| 18 | (III-16) | " | 0.20 | 0.16 | 0.24 | 2.13 | 2.09 | 2.07 | Present invention |
| 19 | (III-19) | " | 0.19 | 0.17 | 0.24 | 2.13 | 2.08 | 2.05 | Present invention |
| 20 | (III-20) | " | 0.18 | 0.16 | 0.24 | 2.12 | 2.08 | 2.05 | Present invention |

EXAMPLE 11

The procedure of Example 5 was repeated using respectively the color developing solutions prepared in Examples 7 and 8 in places of the color developing solutions prepared in Examples 1 and 2, and results shown in Table 11 was obtained.

As is apparent from Table 11, with respect to all of the color developing solutions of Examples 7 and 8, the light-sensitive materials processed using the color developing solutions of the invention have a smaller photographic performance change between before and after the time lapse than the light-sensitive materials processed using the color developing solutions for comparison, and therefore, the color developing solutions of the invention are superior to those for comparison in stability with time lapse.

Further, the following two points were recognized in the color developing solution of the invention that the color developing solutions containing no hydroxylamine sulfate are superior to the color developing solutions containing hydroxylamine sulfate in stability with time lapse, and that the color developing solutions containing 3-methyl-4-amino-N-ethyl-N-hydroxyethylaniline but no benzyl alcohol are superior to those containing 3-methyl-4-amino-N-ethyl-N-(β-methanesulfonamidoethyl)aniline and benzyl alcohol in stability with time lapse.

TABLE 11

| No. | Color developing solution | Change of photographic performance with the time lapse: $\Delta D_B$, 1.0 | $\Delta D_G$, 1.0 | $\Delta D_R$, 1.0 | | No. | Color developing solution | Change of photographic performance with the time lapse: $\Delta D_B$, 1.0 | $\Delta D_G$, 1.0 | $\Delta D_R$, 1.0 | |
|---|---|---|---|---|---|---|---|---|---|---|---|
| | Example 1 | | | | Compara- | 21 | Example 2 | | | | Compara- |

TABLE 11-continued

| No. | Color developing solution | Change of photographic performance with the time lapse $\Delta D_B$, 1.0 | $\Delta D_G$, 1.0 | $\Delta D_R$, 1.0 | | No. | Color developing solution | Change of photographic performance with the time lapse $\Delta D_B$, 1.0 | $\Delta D_G$, 1.0 | $\Delta D_R$, 1.0 | |
|---|---|---|---|---|---|---|---|---|---|---|---|
| 1 | No. 1 | −0.23 | +0.18 | +0.15 | tive example | | No. 1 | −0.30 | +0.25 | +0.15 | tive example |
| 2 | 2 | −0.15 | +0.12 | +0.10 | Present invention | 22 | 2 | −0.12 | +0.10 | +0.08 | Present invention |
| 3 | 3 | −0.15 | +0.13 | +0.11 | Present invention | 23 | 3 | −0.13 | +0.10 | +0.07 | Present invention |
| 4 | 4 | −0.16 | +0.15 | +0.10 | Present invention | 24 | 4 | −0.12 | +0.11 | +0.09 | Present invention |
| 5 | 5 | −0.13 | +0.14 | +0.12 | Present invention | 25 | 5 | −0.11 | +0.09 | +0.10 | Present invention |
| 6 | 6 | −0.15 | +0.12 | +0.11 | Present invention | 26 | 6 | −0.12 | +0.09 | +0.08 | Present invention |
| 7 | 7 | −0.10 | +0.06 | +0.04 | Present invention | 27 | 7 | −0.06 | +0.04 | +0.03 | Present invention |
| 8 | 8 | −0.09 | +0.07 | +0.03 | Present invention | 28 | 8 | −0.07 | +0.03 | +0.02 | Present invention |
| 9 | 9 | −0.08 | +0.07 | +0.04 | Present invention | 29 | 9 | −0.06 | +0.04 | +0.03 | Present invention |
| 10 | 10 | −0.10 | +0.07 | +0.05 | Present invention | 30 | 10 | −0.08 | +0.03 | +0.03 | Present invention |
| 11 | 11 | −0.11 | +0.06 | +0.04 | Present invention | 31 | 11 | −0.07 | +0.03 | +0.02 | Present invention |
| 12 | 12 | −0.10 | +0.08 | +0.04 | Present invention | 32 | 12 | −0.07 | +0.04 | +0.03 | Present invention |
| 13 | 13 | −0.09 | +0.05 | +0.03 | Present invention | 33 | 13 | −0.08 | +0.04 | +0.03 | Present invention |
| 14 | 14 | −0.09 | +0.08 | +0.04 | Present invention | 34 | 14 | −0.06 | +0.03 | +0.02 | Present invention |
| 15 | 15 | −0.10 | +0.05 | +0.05 | Present invention | 35 | 15 | −0.07 | +0.03 | +0.03 | Present invention |
| 16 | 16 | −0.10 | +0.05 | +0.04 | Present invention | 36 | 16 | −0.06 | +0.04 | +0.03 | Present invention |
| 17 | 17 | −0.09 | +0.06 | +0.05 | Present invention | 37 | 17 | −0.06 | +0.04 | +0.03 | Present invention |
| 18 | 18 | −0.10 | +0.07 | +0.04 | Present invention | 38 | 18 | −0.07 | +0.05 | +0.03 | Present invention |
| 19 | 19 | −0.11 | +0.08 | +0.05 | Present invention | 39 | 19 | −0.07 | +0.05 | +0.03 | Present invention |
| 20 | 20 | −0.09 | +0.05 | +0.05 | Present invention | 40 | 20 | −0.08 | +0.03 | +0.04 | Present invention |

EXAMPLE 12

Color developing solutions where diethylenetriaminepentaacetic acid, sodium sulfite and hydroxylamine sulfate in the color developing solution of Example 7 were replaced by compounds shown in Table 12 were prepared. Then, 1 l portions of these color developing solutions were placed in 1 l-beakers, and allowed to stand at room temperature for 3 weeks. Then, observation of these color developing solutions and determination of absorbance thereof were conducted, and the results are shown in Table 12. Color developing solutions Nos. 1 to 7 of the present test were prepared using city water and Nos. 8 to 20 were prepared using demineralized water.

TABLE 12

| No. | | Water used for preparation of the solution | Preservative for color developing solution: Alternative to sodium sulfite | Alternative to hydroxylamine sulfate | chelating compound | State of the solution after the time lapse at room temperature: Coloring degree (absorbance 500 nm) | Formation to tar |
|---|---|---|---|---|---|---|---|
| 1 | Comparative example | City water | — | — | Ethylenediaminetetraacetic acid | Completely blackened | xx |
| 2 | Comparative example | " | Sodium sulfite | Hydroxylamine sulfate | Ethylenediaminetetraacetic acid | 0.42 | Δ |
| 3 | Present invention | " | (III-5) | Hydroxylamine sulfate | Ethylenediaminetetraacetic acid | 0.43 | Δ |
| 4 | Present invention | " | (III-15) | Hydroxylamine sulfate | Ethylenediaminetetraacetic acid | 0.41 | Δ |
| 5 | Present invention | " | (III-5) | (V-8) | Ethylenediaminetetraacetic acid | 0.42 | Δ |
| 6 | Present invention | " | " | (VI-5) | Ethylenediaminetetraacetic acid | 0.39 | Δ |
| 7 | Present invention | " | " | (VI-33) | Ethylenediaminetetraacetic acid | 0.40 | Δ |
| 8 | Present | Demineralized | " | (V-8) | Ethylenediaminetetraacetic | 0.36 | Δ - o |

TABLE 12-continued

| No. | | Water used for preparation of the solution | Preservative for color developing solution: Alternative to sodium sulfite | Preservative for color developing solution: Alternative to hydroxylamine sulfate | chelating compound | State of the solution after the time lapse at room temperature: Coloring degree (absorbance 500 nm) | Formation to tar |
|---|---|---|---|---|---|---|---|
| | invention | water | | | acid | | |
| 9 | Present invention | Demineralized water | " | (VI-5) | Ethylenediaminetetraacetic acid | 0.35 | Δ - o |
| 9 | Present invention | Demineralized water | " | (VI -33) | Ethylenediaminetetraacetic acid | 0.34 | Δ - o |
| 10 | Present invention | Demineralized water | (III-15) | (VI-5) | Ethylenediaminetetraacetic acid | 0.34 | Δ - o |
| 11 | Present invention | Demineralized water | (III-15) | " | Ethylenediaminetetraacetic acid | 0.36 | x |
| 12* | Present invention | Demineralized water | (III-5) | " | Chelating compound A | 0.22 | o |
| 13 | Present invention | Demineralized water | " | " | Chelating compound B | 0.23 | o |
| 14 | Present invention | Demineralized water | " | " | Chelating compound C | 0.26 | o |
| 15 | Present invention | Demineralized water | " | " | Chelating compound D | 0.25 | o |
| 16 | Present invention | Demineralized water | " | " | Chelating compound E | 0.21 | o |
| 17 | Present invention | Demineralized water | " | " | Chelating compound F | 0.20 | o |
| 19 | Present invention | Demineralized water | " | " | Chelating compound G | 0.22 | o |
| 20 | Present invention | Demineralized water | " | " | Chelating compound H | 0.23 | o |

In Table 12, meanings of chelating compounds A to H, symbols of evaluation of tar formation and * are the same as in Example 6.

As apparent from Table 12, the color developing solutions of the invention are superior to the color developing solution of comparative example (2) containing the sulfite and hydroxylamine sulfate on the point of coloring property and formation of tar. Further, the color developing solutions of the invention are much superior to those of comparative example (1) containing no preservative on the point of the above properties.

Further, an result that the color developing solutions prepared using demineralized water are superior to those prepared using city water on the point of coloring degree of the solutions was obtained. In this connection the Fe ion concentration in the city water was $6.0\times10^{-4}$ g per 1 l of the city water, and that in the demineralized water was below $1.0\times10^{-4}$ g and could not be detected.

Further, a result was obtained that the color developing solutions of the invention containing respective chelating compounds of Nos. 13 to 20 are further superior to those containing disodium ethylenediaminetetraacetate dihydrate on the point of coloring degree.

Further, it has been found that the color developing solution containing benzyl alcohol (No.12) is only slightly colored but formation of tar occurs therein.

EXAMPLE 13

The procedure in Example 1 was repeated except that compounds shown in Table 13 were used as an alternative of sodium sulfite or an alternative of hydroxylamino sulfate, respectively, and results shown in Table 13 were obtained.

TABLE 13

| No. | Preservative for the color developing solution: Alternative to sodium sulfite | Preservative for the color developing solution: Alternative of hydroxylamine sulfate | Minimum density (Dmin): Yellow | Minimum density (Dmin): Magenta | Minimum density (Dmin): Cyan | Maximum density (Dmax): Yellow | Maximum density (Dmax): Magenta | Maximum density (Dmax): Cyan | |
|---|---|---|---|---|---|---|---|---|---|
| 1 | Sodium sulfite | Hydroxylamine sulfate | 0.35 | 0.22 | 0.41 | 1.80 | 1.85 | 1.73 | Comparative example |
| 2 | Example Compound (IV-1) | Hydroxylamine sulfate | 0.21 | 0.18 | 0.22 | 1.92 | 1.94 | 1.82 | Present invention |
| 3 | Example Compound (IV-3) | Hydroxylamine sulfate | 0.23 | 0.19 | 0.23 | 1.93 | 1.95 | 1.80 | Present invention |
| 4 | Example Compound (IV-5) | Hydroxylamine sulfate | 0.21 | 0.20 | 0.21 | 1.95 | 1.95 | 1.81 | Present invention |
| 5 | Example Compound (IV-7) | Hydroxylamine sulfate | 0.22 | 0.17 | 0.24 | 1.90 | 1.93 | 1.80 | Present invention |
| 6 | Example Compound (IV-9) | Hydroxylamine sulfate | 0.23 | 0.18 | 0.21 | 1.93 | 1.94 | 1.81 | Present invention |
| 7 | Example Compound (IV-1) | Example compound (VI-5) | 0.18 | 0.16 | 0.17 | 2.13 | 2.12 | 2.05 | Present invention |
| 8 | Example Compound (IV-3) | Example compound (VI-5) | 0.19 | 0.17 | 0.18 | 2.04 | 2.13 | 2.06 | Present invention |
| 9 | Example | Example | 0.20 | 0.18 | 0.16 | 2.17 | 2.14 | 2.07 | Present |

TABLE 13-continued

| No. | Preservative for the color developing solution: Alternative to sodium sulfite | Alternative of hydroxylamine sulfate | Minimum density (Dmin) Yellow | Magenta | Cyan | Maximum density (Dmax) Yellow | Magenta | Cyan | |
|---|---|---|---|---|---|---|---|---|---|
| | Compound (IV-5) | compound (VI-5) | | | | | | | invention |
| 10 | Example Compound (IV-7) | Example compound (VI-5) | 0.19 | 0.18 | 0.16 | 2.16 | 2.15 | 2.05 | Present invention |
| 11 | Example Compound (IV-9) | Example compound (VI-5) | 0.18 | 0.16 | 0.15 | 2.13 | 2.13 | 2.06 | Present invention |
| 12 | Example Compound (IV-1) | Example compound (VI-33) | 0.16 | 0.17 | 0.15 | 2.15 | 2.12 | 2.06 | Present invention |
| 13 | Example Compound (IV-3) | Example compound (VI-33) | 0.17 | 0.15 | 0.14 | 2.14 | 2.12 | 2.05 | Present invention |
| 14 | Example Compound (IV-5) | Example compound (VI-33) | 0.16 | 0.15 | 0.16 | 2.18 | 2.14 | 2.04 | Present invention |
| 15 | Example Compound (IV-7) | Example compound (VI-33) | 0.14 | 0.18 | 0.17 | 2.18 | 2.13 | 2.06 | Present invention |
| 16 | Example Compound (IV-9) | Example compound (VI-33) | 0.15 | 0.16 | 0.16 | 2.16 | 2.11 | 2.04 | Present invention |
| 17 | Example Compound (IV-9) | Example compound (V-8) | 0.16 | 0.18 | 0.15 | 2.14 | 2.12 | 2.08 | Present invention |
| 18 | Example Compound (IV-9) | Example compound (V-12) | 0.17 | 0.17 | 0.17 | 2.15 | 2.12 | 2.04 | Present invention |
| 19 | Example Compound (IV-9) | Example compound (V-17) | 0.16 | 0.16 | 0.17 | 2.16 | 2.13 | 2.07 | Present invention |
| 20 | Example Compound (IV-9) | Example compound (V-20) | 0.15 | 0.18 | 0.15 | 2.15 | 2.15 | 2.08 | Present invention |

As is apparent from Table 13, when the light-sensitive material is processed with a color developing solution which containing a compound represented by the general formula (IV) of the invention in place of sodium sulfite, an image which is having a high maximum density (Dmax) and surprisingly also having a low minimum density, and thus excellent in discrimination was obtained. Particularly when another hydroxyamine and/or a hydroxypolyimine were used in place of hydroxylamine sulfate together with a compound of the general formula (IV), particularly excellent results was obtained.

EXAMPLE 14

The color photographic light-sensitive material 101 has processed using the process steps of Example 2 in place of those of Example 13. Then, the resulting light-sensitive material 101 was subjected to exposure to light and then process steps in the same manner as in example 1, and Dmax and Dmin were determined. The resulting results are shown in Table 14, and were similar to those of Example 13.

TABLE 14

| No. | Preservative for the color developing solution: Alternative to sodium sulfite | Alternative of hydroxylamine sulfate | Minimum density (Dmin) Yellow | Magenta | Cyan | Maximum density (Dmax) Yellow | Magenta | Cyan | |
|---|---|---|---|---|---|---|---|---|---|
| 1 | Sodium sulfite | Hydroxylamine sulfate | 0.48 | 0.27 | 0.49 | 1.74 | 1.83 | 1.70 | Comparative example |
| 2 | Exemplified compound IV-(1) | Hydroxylamine sulfate | 0.30 | 0.22 | 0.32 | 1.90 | 1.96 | 1.85 | Present invention |
| 3 | Exemplified compound IV-(3) | Hydroxylamine sulfate | 0.33 | 0.21 | 0.35 | 1.91 | 1.98 | 1.86 | Present invention |
| 4 | Exemplified compound IV-(5) | Hydroxylamine sulfate | 0.31 | 0.21 | 0.33 | 1.93 | 1.98 | 1.88 | Present invention |
| 5 | Exemplified compound IV-(7) | Hydroxylamine sulfate | 0.32 | 0.24 | 0.32 | 1.92 | 1.96 | 1.85 | Present invention |
| 6 | Exemplified compound IV-(9) | Hydroxylamine sulfate | 0.29 | 0.23 | 0.31 | 1.92 | 1.97 | 1.84 | Present invention |
| 7 | Exemplified compound IV-(1) | Exemplified compound (VI-5) | 0.23 | 0.18 | 0.23 | 2.18 | 2.14 | 2.00 | Present invention |
| 8 | Exemplified compound IV-(3) | Exemplified compound (VI-5) | 0.21 | 0.20 | 0.24 | 2.20 | 2.13 | 2.03 | Present invention |
| 9 | Exemplified compound IV-(5) | Exemplified compound (VI-5) | 0.24 | 0.19 | 0.22 | 2.19 | 2.14 | 2.02 | Present invention |
| 10 | Exemplified compound IV-(7) | Exemplified compound (VI-5) | 0.22 | 0.18 | 0.23 | 2.18 | 2.13 | 2.00 | Present invention |
| 11 | Exemplified compound IV-(9) | Exemplified compound (VI-5) | 0.23 | 0.20 | 0.25 | 2.17 | 2.14 | 1.98 | Present invention |
| 12 | Exemplified compound IV-(1) | Exemplified compound (VI-33) | 0.20 | 0.18 | 0.21 | 2.17 | 2.15 | 2.05 | Present invention |
| 13 | Exemplified compound IV-(3) | Exemplified compound (VI-33) | 0.21 | 0.17 | 0.22 | 2.16 | 2.14 | 2.03 | Present invention |
| 14 | Exemplified compound IV-(5) | Exemplified compound (VI-33) | 0.22 | 0.16 | 0.21 | 2.18 | 2.11 | 2.04 | Present invention |

TABLE 14-continued

| No. | Preservative for the color developing solution: Alternative to sodium sulfite | Alternative of hydroxylamine sulfate | Minimum density (Dmin): Yellow | Magenta | Cyan | Maximum density (Dmax): Yellow | Magenta | Cyan | |
|---|---|---|---|---|---|---|---|---|---|
| 15 | Exemplified compound IV-(7) | Exemplified compound (VI-33) | 0.21 | 0.18 | 0.20 | 2.17 | 2.14 | 2.04 | Present invention |
| 16 | Exemplified compound IV-(1) | Exemplified compound (V-1) | 0.21 | 0.19 | 0.19 | 2.16 | 2.12 | 2.07 | Present invention |
| 17 | Exemplified compound IV-(1) | Exemplified compound (V-18) | 0.21 | 0.18 | 0.20 | 0.17 | 2.12 | 2.06 | Present invention |
| 18 | Exemplified compound IV-(1) | Exemplified compound (V-12) | 0.20 | 0.19 | 0.20 | 2.15 | 2.14 | 2.04 | Present invention |
| 19 | Exemplified compound IV-(1) | Exemplified compound (V-17) | 0.21 | 0.19 | 0.18 | 2.14 | 2.13 | 2.05 | Present invention |
| 20 | Exemplified compound IV-(1) | Exemplified compound (V-20) | 0.24 | 0.20 | 0.19 | 2.15 | 2.15 | 2.05 | Present invention |

EXAMPLE 15

The light-sensitive material 301 (please refer to Example 3) was exposed to light in the same manner as in Example 13, and subjected to color development, bleach-fixing and water washing processes in the same manner as in Example 3. The light-sensitive material was then processed in the same manner as in Example 13. The resulting results are shown in Table 15, and were similar to those obtained in Example 13.

EXAMPLE 16

The color photographic light-sensitive material 401 (please refer to Example 4) was subjected to color developing, bleach-fixing, stabilization and drying processes in the same manner as in Example 10.

Then, the above process was repeated using compounds in Table 16 in place of sodium sulfite and sodium sulfate in the color developing solution in the same molar amount therewith. The resulting results which

TABLE 15

| No. | Preservative for the color developing solution: Alternative to sodium sulfite | Alternative of hydroxylamine sulfate | Minimum density (Dmin): Yellow | Magenta | Cyan | Maximum density (Dmax): Yellow | Magenta | Cyan | |
|---|---|---|---|---|---|---|---|---|---|
| 1 | Sodium sulfite | Hydroxylamine sulfate | 0.38 | 0.25 | 0.40 | 1.78 | 1.85 | 1.72 | Comparative example |
| 2 | Exemplified compound IV-(1) | Hydroxylamine sulfate | 0.26 | 0.20 | 0.27 | 1.92 | 1.95 | 1.84 | Present invention |
| 3 | Exemplified compound IV-(3) | Hydroxylamine sulfate | 0.24 | 0.21 | 0.25 | 1.93 | 1.94 | 1.82 | Present invention |
| 4 | Exemplified compound IV-(5) | Hydroxylamine sulfate | 0.25 | 0.19 | 0.28 | 1.95 | 1.94 | 1.82 | Present invention |
| 5 | Exemplified compound IV-(7) | Hydroxylamine sulfate | 0.24 | 0.19 | 0.26 | 1.94 | 1.96 | 1.84 | Present invention |
| 6 | Exemplified compound IV-(9) | Hydroxylamine sulfate | 0.24 | 0.20 | 0.26 | 1.91 | 1.93 | 1.81 | Present invention |
| 7 | Exemplified compound IV-(1) | Exemplified compound (VI-5) | 0.20 | 0.18 | 0.19 | 2.03 | 2.10 | 2.03 | Present invention |
| 8 | Exemplified compound IV-(3) | Exemplified compound (VI-5) | 0.19 | 0.17 | 0.20 | 2.10 | 2.11 | 2.02 | Present invention |
| 9 | Exemplified compound IV-(5) | Exemplified compound (VI-5) | 0.20 | 0.17 | 0.19 | 2.09 | 2.11 | 2.02 | Present invention |
| 10 | Exemplified compound IV-(7) | Exemplified compound (VI-5) | 0.21 | 0.18 | 0.18 | 2.10 | 2.12 | 2.01 | Present invention |
| 11 | Exemplified compound IV-(9) | Exemplified compound (VI-5) | 0.21 | 0.18 | 0.18 | 2.11 | 2.12 | 2.02 | Present invention |
| 12 | Exemplified compound IV-(1) | Exemplified compound (VI-33) | 0.18 | 0.16 | 0.17 | 2.12 | 2.12 | 2.03 | Present invention |
| 13 | Exemplified compound IV-(3) | Exemplified compound (VI-33) | 0.17 | 0.15 | 0.17 | 2.11 | 2.13 | 2.05 | Present invention |
| 14 | Exemplified compound IV-(5) | Exemplified compound (VI-33) | 0.18 | 0.14 | 0.16 | 2.13 | 2.12 | 2.06 | Present invention |
| 15 | Exemplified compound IV-(7) | Exemplified compound (VI-33) | 0.17 | 0.15 | 0.16 | 2.15 | 2.14 | 2.04 | Present invention |
| 16 | Exemplified compound IV-(1) | Exemplified compound (V-1) | 0.19 | 0.16 | 0.17 | 2.13 | 2.12 | 2.03 | Present invention |
| 17 | Exemplified compound IV-(1) | Exemplified compound (V-8) | 0.18 | 0.15 | 0.18 | 2.14 | 2.14 | 2.01 | Present invention |
| 18 | Exemplified compound IV-(1) | Exemplified compound (V-12) | 0.17 | 0.15 | 0.18 | 2.13 | 2.15 | 2.02 | Present invention |
| 19 | Exemplified compound IV-(1) | Exemplified compound (V-17) | 0.18 | 0.15 | 0.17 | 2.13 | 2.12 | 2.01 | Present invention |
| 20 | Exemplified compound IV-(1) | Exemplified compound (V-25) | 0.16 | 0.15 | 0.18 | 2.14 | 2.12 | 2.03 | Present invention |

revealed a tendency similar to those in Example 13 are shown in Table 16.

TABLE 16

| No. | Preservative for the color developing solution: Alternative to sodium sulfite | Alternative of hydroxylamine sulfate | Minimum density (Dmin): Yellow | Magenta | Cyan | Maximum density (Dmax): Yellow | Magenta | Cyan | |
|---|---|---|---|---|---|---|---|---|---|
| 1 | Sodium sulfite | Hydroxylamine sulfate | 0.52 | 0.30 | 0.53 | 1.68 | 1.65 | 1.62 | Comparative example |
| 2 | Exemplified compound IV-(1) | Hydroxylamine sulfate | 0.38 | 0.23 | 0.33 | 1.85 | 1.82 | 1.75 | Present invention |
| 3 | Exemplified compound IV-(3) | Hydroxylamine sulfate | 0.40 | 0.24 | 0.30 | 1.83 | 1.80 | 1.76 | Present invention |
| 4 | Exemplified compound IV-(5) | Hydroxylamine sulfate | 0.38 | 0.23 | 0.31 | 1.84 | 1.80 | 1.77 | Present invention |
| 5 | Exemplified compound IV-(7) | Hydroxylamine sulfate | 0.39 | 0.22 | 0.32 | 1.83 | 1.81 | 1.79 | Present invention |
| 6 | Exemplified compound IV-(9) | Hydroxylamine sulfate | 0.39 | 0.24 | 0.30 | 1.84 | 1.81 | 1.76 | Present invention |
| 7 | Exemplified compound IV-(1) | Exemplified compound (VI-5) | 0.25 | 0.22 | 0.24 | 1.98 | 1.88 | 1.84 | Present invention |
| 8 | Exemplified compound IV-(3) | Exemplified compound (VI-5) | 0.23 | 0.21 | 0.22 | 1.93 | 1.86 | 1.83 | Present invention |
| 9 | Exemplified compound IV-(5) | Exemplified compound (VI-5) | 0.24 | 0.23 | 0.24 | 1.95 | 1.88 | 1.84 | Present invention |
| 10 | Exemplified compound IV-(7) | Exemplified compound (VI-5) | 0.25 | 0.22 | 0.23 | 1.97 | 1.89 | 1.85 | Present invention |
| 11 | Exemplified compound IV-(9) | Exemplified compound (VI-5) | 0.24 | 0.21 | 0.24 | 1.98 | 1.87 | 1.83 | Present invention |
| 12 | Exemplified compound IV-(1) | Exemplified compound (VI-33) | 0.24 | 0.20 | 0.25 | 2.03 | 1.95 | 1.90 | Present invention |
| 13 | Exemplified compound IV-(3) | Exemplified compound (VI-33) | 0.23 | 0.21 | 0.27 | 2.04 | 1.94 | 1.92 | Present invention |
| 14 | Exemplified compound IV-(5) | Exemplified compound (VI-33) | 0.24 | 0.22 | 0.24 | 2.04 | 1.93 | 1.92 | Present invention |
| 15 | Exemplified compound IV-(7) | Exemplified compound (VI-33) | 0.22 | 0.21 | 0.25 | 2.03 | 1.97 | 1.91 | Present invention |
| 16 | Exemplified compound IV-(1) | Exemplified compound (V-1) | 0.22 | 0.21 | 0.26 | 2.01 | 1.92 | 1.88 | Present invention |
| 17 | Exemplified compound IV-(1) | Exemplified compound (V-8) | 0.21 | 0.20 | 0.29 | 2.00 | 1.92 | 1.86 | Present invention |
| 18 | Exemplified compound IV-(1) | Exemplified compound (V-12) | 0.23 | 0.23 | 0.29 | 1.99 | 1.91 | 1.87 | Present invention |
| 19 | Exemplified compound IV-(1) | Exemplified compound (V-17) | 0.21 | 0.22 | 0.26 | 1.98 | 1.93 | 1.87 | Present invention |
| 20 | Exemplified compound IV-(1) | Exemplified compound (V-20) | 0.22 | 0.22 | 0.25 | 2.00 | 1.92 | 1.86 | Present invention |

EXAMPLE 17

The procedure of Example 5 was repeated using respectively the color developing solutions prepared in Examples 13 and 14 in place of the color developing solutions prepared in Examples 1 and 2, and results shown in Table 17 was obtained.

TABLE 17

| No. | Color developing solution | Change of photographic performance with the time lapse: $\Delta D_B$, 1.0 | $\Delta D_G$, 1.0 | $\Delta D_R$, 1.0 | |
|---|---|---|---|---|---|
| 1 | Example 13 No. 1 | −0.23 | +0.18 | +0.15 | Comparative example |
| 2 | 2 | −0.18 | +0.15 | +0.11 | Present invention |
| 3 | 3 | −0.17 | +0.14 | +0.11 | Present invention |
| 4 | 4 | −0.18 | +0.14 | +0.11 | Present invention |
| 5 | 5 | −0.12 | +0.09 | +0.06 | Present invention |
| 6 | 6 | −0.11 | +0.08 | +0.05 | Present invention |
| 7 | 7 | −0.12 | +0.08 | +0.07 | Present invention |
| 8 | 8 | −0.12 | +0.08 | +0.06 | Present invention |
| 9 | 9 | −0.12 | +0.09 | +0.07 | Present invention |
| 10 | 10 | −0.11 | +0.09 | +0.06 | Present invention |
| 11 | 11 | −0.12 | +0.08 | +0.06 | Present invention |
| 12 | 12 | −0.12 | +0.09 | +0.06 | Present invention |
| 13 | 13 | −0.13 | +0.09 | +0.06 | Present invention |
| 14 | 14 | −0.10 | +0.08 | +0.07 | Present invention |
| 15 | 15 | −0.10 | +0.08 | +0.06 | Present invention |
| 16 | 16 | −0.12 | +0.07 | +0.06 | Present invention |
| 17 | 17 | −0.12 | +0.08 | +0.07 | Present invention |
| 18 | 18 | −0.11 | +0.09 | +0.07 | Present invention |
| 19 | 19 | −0.12 | +0.08 | +0.06 | Present invention |
| 20 | 20 | −0.12 | +0.07 | +0.06 | Present invention |
| 21 | Example 14 No. 1 | −0.30 | +0.25 | +0.15 | Comparative example |

TABLE 17-continued

| No. | Color developing solution | Change of photographic performance with the time lapse | | | |
|---|---|---|---|---|---|
| | | Δ $D_B$, 1.0 | Δ $D_G$, 1.0 | Δ $D_R$, 1.0 | |
| 22 | 2 | −0.15 | +0.12 | +0.10 | Present invention |
| 23 | 3 | −0.16 | +0.11 | +0.09 | Present invention |
| 24 | 4 | −0.16 | +0.11 | +0.09 | Present invention |
| 25 | 5 | −0.09 | +0.05 | +0.03 | Present invention |
| 26 | 6 | −0.10 | +0.04 | +0.02 | Present invention |
| 27 | 7 | −0.10 | +0.05 | +0.03 | Present invention |
| 28 | 8 | −0.09 | +0.06 | +0.03 | Present invention |
| 29 | 9 | −0.09 | +0.05 | +0.03 | Present invention |
| 30 | 10 | −0.09 | +0.05 | +0.02 | Present invention |
| 31 | 11 | −0.09 | +0.06 | +0.03 | Present invention |
| 32 | 12 | −0.10 | +0.05 | +0.03 | Present invention |
| 33 | 13 | −0.10 | +0.04 | +0.04 | Present invention |
| 34 | 14 | −0.10 | +0.05 | +0.03 | Present invention |
| 35 | 15 | −0.09 | +0.05 | +0.03 | Present invention |
| 36 | 16 | −0.09 | +0.04 | +0.03 | Present invention |
| 37 | 17 | −0.09 | +0.04 | +0.02 | Present invention |
| 38 | 18 | −0.10 | +0.04 | +0.03 | Present invention |
| 39 | 19 | −0.10 | +0.05 | +0.04 | Present invention |
| 40 | 20 | −0.09 | +0.05 | +0.03 | Present invention |

As is apparent from Table 17, with respect to all of the color developing solutions of Examples 13 and 14, the light-sensitive materials processed using the color developing solutions of the invention have a smaller photographic performance change between before and after the time lapse than the light-sensitive materials processed using the color developing solutions for comparison, and therefore, the color developing solutions of the invention are superior to those of the comparison in stability with time lapse.

Further, the following two points were recognized in the color developing solution of the invention that the color developing solutions containing no hydroxylamine sulfate are superior to the color developing solutions containing hydroxylamine sulfate in stability with time lapse, and that the color developing solutions containing 3-methyl-4-amino-N-ethyl-N-hydroxyethylaniline but no benzyl alcohol are superior to those containing 3-methyl-4-amino-N-ethyl-N-(β-methanesulfonamidoethyl)aniline and benzyl alcohol in stability with time lapse.

EXAMPLE 18

Color developing solutions where diethylenetriaminepentaacetic acid, sodium sulfite and hydroxylamine sulfate in the color developing solution of example 13 were replaced by compounds shown in Table 18 were prepared. Then, 1 l portions of these color developing solutions were placed in 1 l-beakers, and allowed to stand at room temperature for 3 weeks. Then, observation of these color developing solutions and determination of absorbance thereof were conducted, and the results are shown in Table 18. Color developing solutions Nos. 1 to 7 of the present test were prepared using city water and Nos. 8 to 20 were prepared using demineralized water.

TABLE 18

| No. | | Water used for preparation of the solution | Preservative for color developing solution | | Chelating compound | State of the solution after the time lapse at room temperature | |
|---|---|---|---|---|---|---|---|
| | | | Alternative to sodium sulfite | Alternative to hydroxylamine sulfate | | Coloring degree (absorbance 500 nm) | Formation to TAR |
| 1 | Comparative example | City water | — | — | Ethylenediaminetetraacetic acid | Completely blackened | xx |
| 2 | Comparative example | " | Sodium sulfite | Hydroxylamine sulfite | Ethylenediaminetetraacetic acid | 0.42 | Δ |
| 3 | Present invention | " | IV-(1) | Hydroxylamine sulfite | Ethylenediaminetetraacetic acid | 0.41 | Δ |
| 4 | Present invention | " | IV-(8) | Hydroxylamine sulfite | Ethylenediaminetetraacetic acid | 0.41 | Δ |
| 5 | Present invention | " | IV-(1) | (VI-5) | Ethylenediaminetetraacetic acid | 0.38 | Δ |
| 6 | Present invention | " | " | (VI-33) | Ethylenediaminetetraacetic acid | 0.40 | Δ |
| 7 | Present invention | " | " | (VI-8) | Ethylenediaminetetraacetic acid | 0.39 | Δ |
| 8 | Present invention | Demineralized water | " | (VI-5) | Ethylenediaminetetraacetic acid | 0.30 | Δ-o |
| 9 | Present invention | Demineralized water | " | (VI-33) | Ethylenediaminetetraacetic acid | 0.27 | Δ-o |
| 10 | Present invention | Demineralized water | " | (VI-8) | Ethylenediaminetetraacetic acid | 0.28 | Δ-o |
| 11 | Present invention | Demineralized water | IV-(8) | (VI-5) | Ethylenediaminetetraacetic acid | 0.30 | Δ-o |
| 12* | Present | Demineralized | IV-(1) | " | Ethylenediaminetetraacetic | 0.31 | x |

TABLE 18-continued

| No. | | Water used for preparation of the solution | Preservative for color developing solution: Alternative to sodium sulfite | Preservative for color developing solution: Alternative to hydroxylamine sulfate | Chelating compound | State of the solution after the time lapse at room temperature: Coloring degree (absorbance 500 nm) | State of the solution after the time lapse at room temperature: Formation to TAR |
|---|---|---|---|---|---|---|---|
| | invention | water | | | acid | | |
| 13 | Present invention | Demineralized water | Sodium sulfite IV-(1) | Hydroxylamine sulfite (VI-5) | Chelating compound A | 0.25 | o |
| 14 | Present invention | Demineralized water | Sodium sulfite IV-(1) | Hydroxlyamine sulfite (VI-5) | Chelating compound B | 0.23 | o |
| 15 | Present invention | Demineralized water | Sodium sulfite IV-(1) | Hydroxlyamine sulfite (VI-5) | Chelating compound C | 0.22 | o |
| 16 | Present invention | Demineralized water | Sodium sulfite IV-(1) | Hydroxlyamine sulfite (VI-5) | Chelating compound D | 0.21 | o |
| 17 | Present invention | Demineralized water | Sodium sulfite IV-(1) | Hydroxlyamine sulfite (VI-5) | Chelating compound E | 0.26 | o |
| 18 | Present invention | Demineralized water | Sodium sulfite IV-(1) | Hydroxlyamine sulfite (VI-5) | Chelating compound F | 0.25 | o |
| 19 | Present invention | Demineralized water | Sodium sulfite IV-(1) | Hydroxlyamine sulfite (VI-5) | Chelating compound G | 0.24 | o |
| 20 | Present invention | Demineralized water | Sodium sulfite IV-(1) | Hydroxlyamine sulfite | Chelating compound H | 0.26 | o |

In Table 18, meanings of chelating compounds A to H, symbols of evaluation of tar formation and * are the same as in Example 6.

As apparent from Table 18, the color developing solutions of the invention are superior to the color developing solution of comparative example (2) containing the sulfite and hydroxylamine sulfate on the point of coloring property and formation of tar. Further, the color developing solutions of the invention are much superior to those of comparative example (1) containing no preservative on the point cf the above properties.

Further, an result that the color developing solutions prepared using demineralized water are superior to those prepared using city water on the point of coloring degree of the solutions was obtained. In this connection the Fe ion concentration in the city water was $6.0\times10^{-4}$ g per 1 l of the city water, and that in the demineralized water was below $1.0\times10^{-4}$ g and could not be detected.

Further, a result was obtained that the color developing solutions of the invention containing respective chelating compounds of Nos. 13 to 20 are further superior to those containing disodium ethylenediaminetetraacetate dihydrate on the point of coloring degree.

Further, it has been found that the color developing solution containing benzyl alcohol (No.12) is only slightly colored but formation of tar occurs therein.

According to methods of the present invention, since stability of the color developing solutions with time lapse is excellent, stable continuous process of color photographic light-sensitive materials may be conducted over a long period, and generation of rereversal negative images, namely generation of stain during continuous process is not so observed. Further, even by processing of color photographic light-sensitive materials with color developing solutions containing no benzyl alcohol in the invention, direct positive color images having an excellent coloring property may be formed, and thus methods of the invention are excellent in view of pollution inhibition and environmental hygiene, too.

What is claimed is:

1. A method for forming a direct positive color image comprising image-wise exposing to light a light-sensitive material having at least one internal latent image type silver halide emulsion layer which is unfogged and at least one color image-forming coupler on a support; either (1) subjecting the resulting material to fogging exposure to light and/or processing it with a nucleating agent before development, and then developing the resulting material with a surface developing solution containing an aromatic primary amine type color developing agent, or (2) developing the material after the image-wise exposure with a surface developing solution containing an aromatic primary amine type color developing agent under fogging exposure and/or in the presence of a nucleating agent; and bleach-fixing the resulting material, wherein the color developing solution contains at least one compound selected from the group consisting of compounds represented by the following general formulae (III), (IV-a) and (IV-b) or a dimer or a polymer which are obtained by dimerizing or polymerizing the compound of the formulae (III), (IV-a) or (IV-b):

General formula (III)

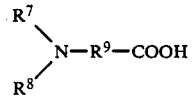

wherein $R^7$ and $R^8$ each represent a hydrogen atom, or a substituted or unsubstituted alkyl group, $R_9$ represents a substituted or unsubstituted alkylene group, and sum of carbon number of $R^7$, $R^8$ and $R^9$ is 3 or more;

General formula (IV-a)

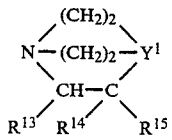

wherein $Y^1$ represents —N or —CH, and $R^{13}$, $R^{14}$ and $R^{15}$ each represent a hydrogen atom, a lower alkyl group, a hydroxy-substituted lower alkyl group, a hydroxyl group or an alkoxy group, and $R^{14}$ and $R^{15}$ may combine to form a carbonyl group; and General formula (IV-b)

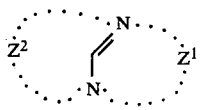

wherein $Z^1$ and $Z^2$ each represents a methylene chain having 2 to 8 carbon atoms necessary for forming a heterocycle, and $Z^1$ and $Z^2$ may each have one or more substituents thereon.

2. The method for forming a direct positive color image of claim 1 wherein the amount of compounds of the general formula (III), (IV-a) or (IV-b) to be added per 1 l of the color developing solution is 0.01 to 50 g, 0.1 to 50 g and 0.1 to 50 g respectively.

3. The method for a forming a direct positive color image of claim 1 wherein the color developing solution further contains at least one of the compounds represented by the general formulae (V) and (VI);

General Formula (V)

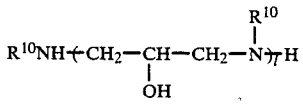

wherein $R^{10}$ represents a hydrogen atom, a substituted or unsubstituted alkyl group, a substituted or unsubstituted aryl group and l represents an integer of 2 or more;

General Formula (VI)

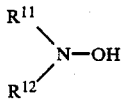

wherein $R^{11}$ and $R^{12}$ each represent a hydrogen atom, an unsubstituted or substituted alkyl group, an unsubstituted or substituted alkenyl group, or an unsubstituted or substituted aryl group.

4. The method for forming a direct positive color image of claim 3 wherein the compound represented by the general formula (V) is a compound consisting of the following repeating units (V-A) and (V-B):

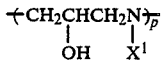

(V-A)

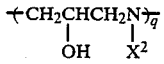

(V-B)

wherein p and q each represent an integer of 1 to 2,000,000, and $X^1$ and $X^2$ are different but each has the same meaning as $R^{10}$.

5. The method for forming a direct positive color image of claim 3 wherein the substituent(s) in the definition of $R^{11}$ and $R^{12}$ is(are) halogen atom(s), substituted or unsubstituted aryl group(s), substituted or unsubstituted alkoxy group(s), aryloxy group(s), alkane- or arylsulfonyl group(s), alkane- or arylsulfonamido group(s), substituted or unsubstituted sulfamoyl group(s), substituted or unsubstituted carbamoyl group(s), amido group(s), substituted or unsubstituted ureido group(s), alkoxycarbonylamino group(s), aryloxycarbonylamino group(s), alkoxycarbonyl group(s), aryloxycarbonyl group(s), cyano group(s), hydroxyl group(s), carboxyl group(s), sulfo group(s), nitro group(s), substituted or unsubstituted amino group(s), alkylthio group(s), arylthio group(s) or heterocyclic group(s).

6. The method for forming a direct positive color image of claim 3 wherein amounts of the compounds of the general formulae (V) and (VI) to be added per 1 l of the color developing solution are 0.01 to 50 g and 0.1 to 20 g, respectively.

7. The method for forming a direct positive color image of claim 1 wherein the color developing solution does not substantially contain benzyl alcohol.

8. The method for forming a direct positive color image of claim 1 wherein iron ion concentration in the color developing solution is $5\times10^{-4}$ g or less per 1 l of the solution.

9. The method for forming a direct positive color image of claim 1 wherein the color developing solution further contains at least one compound selected from the following compound group A:

Compound group A

Ethylenediaminetetramethylenephosphonic acid,
1-Hydroxyethylidene-1,1-diphosphonic acid,
Cyclohexanediaminetetraacetic acid,
Diethylenetriaminepentaacetic acid,
Triethylenetetraaminehexaacetic acid,
Diethylenetriaminepentamethylenephosphonic acid,
Triethylenetetraaminehexamethylenephosphonic acid,
Nitrilo-N,N,N-triacetic acid,
Nitrilo-N,N,N,-trimethylenephosphonic acid,
Diaminopropanoltetraacetic acid,
1,2,4-Tricarboxy-2-butanephosphonic acid,
5-Sulfosalicyclic acid,
and alkali metal salts or alkaline earth metal salts of each of the above compounds.

10. The method for forming a direct positive color image of claim 9 wherein at least one compound selected from the compound group A is contained in the color developing solution in an amount of $1\times10^{-4}$–$1\times10^{-1}$ mole per liter of the color developing solution.

* * * * *